US008277013B2

(12) United States Patent
Sugahara

(10) Patent No.: US 8,277,013 B2
(45) Date of Patent: Oct. 2, 2012

(54) PRINTER

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 526 days.

(21) Appl. No.: 12/553,380

(22) Filed: Sep. 3, 2009

(65) Prior Publication Data

US 2010/0060692 A1 Mar. 11, 2010

(30) Foreign Application Priority Data

Sep. 8, 2008 (JP) ..... 2008-229548

(51) Int. Cl.
*B41J 29/38* (2006.01)

(52) U.S. Cl. ..... 347/16; 347/104

(58) Field of Classification Search ..... 347/16, 347/104

See application file for complete search history.

(56) References Cited

U.S. PATENT DOCUMENTS

| | | | | |
|---|---|---|---|---|
| 5,260,716 | A * | 11/1993 | Maslanka | 347/214 |
| 5,389,958 | A * | 2/1995 | Bui et al. | 347/103 |
| 5,455,604 | A * | 10/1995 | Adams et al. | 346/138 |
| 5,488,396 | A * | 1/1996 | Burke et al. | 347/37 |
| 5,790,160 | A * | 8/1998 | Reeves et al. | 347/103 |
| 5,820,275 | A * | 10/1998 | Crawford et al. | 400/185 |
| 6,292,649 | B1 * | 9/2001 | Toyama et al. | 399/384 |
| 6,460,991 | B1 | 10/2002 | Temple et al. | |
| 6,508,551 | B1 * | 1/2003 | Snyder | 347/102 |
| 6,682,191 | B2 | 1/2004 | Temple et al. | |
| 2003/0103123 | A1 * | 6/2003 | Snyder | 347/102 |
| 2004/0155949 | A1 * | 8/2004 | Masuda | 347/115 |
| 2004/0257427 | A1 * | 12/2004 | Fukushima et al. | 347/217 |
| 2006/0284950 | A1 * | 12/2006 | Kessler | 347/103 |
| 2006/0290761 | A1 * | 12/2006 | Cellura et al. | 347/103 |
| 2007/0030323 | A1 * | 2/2007 | Snyder et al. | 347/89 |

FOREIGN PATENT DOCUMENTS

| | | |
|---|---|---|
| JP | 2033040 | 2/1990 |
| JP | 2305757 | 12/1990 |
| JP | 11091988 | 4/1999 |
| JP | 2001-031309 | 2/2001 |
| JP | 2001-514107 | 9/2001 |
| JP | 2005-194043 | 7/2005 |

* cited by examiner

*Primary Examiner* — Ryan Lepisto
*Assistant Examiner* — Guy Anderson
(74) *Attorney, Agent, or Firm* — Frommer Lawrence & Haug LLP

(57) ABSTRACT

There is provided a printer which includes two rotatable bodies, two rotational drive mechanisms which drives the two rotatable body, respectively, two attaching mechanisms which attach a printing medium to the two rotatable bodies, respectively, an ink-jet head arranged to face one of the rotatable bodies, a transfer mechanism which has a first transfer path connecting the two rotational bodies with passing a facing area facing the two rotational bodies and a second transfer path connecting the two rotational bodies without passing the facing area, and a transporting control mechanism which controls the two rotational drive mechanisms to transfer the printing medium from one rotatable body to the other rotatable body via the first transfer path, and from the other rotatable body to the one rotatable body via the second transfer path.

14 Claims, 17 Drawing Sheets

PRINTER

CROSS REFERENCE TO RELATED APPLICATION

The present application claims priority from Japanese Patent Application No. 2008-229548, filed on Sep. 8, 2008, the disclosure of which is incorporated herein by reference in its entirety.

BACKGROUND OF THE INVENTION

1. Field of the Invention

The present invention relates to a printer which is capable of carrying out a double face printing.

2. Description of the Related Art

A double face printer in which it is possible to print characters and/or images on both surfaces of a printing medium such as a printing paper has hitherto been known. For instance, in a certain double face printer, one surface (front surface) of a printing paper is printed by a printing head, the printing paper is turned over by a switch-back mechanism, the paper is sent once again to the printing head, and the other surface (rear surface) of the printing paper is printed.

Moreover, a printer in which a rear surface of the printing medium is turned over by using a drum which rotates while holding the printing medium has also been known. For example, another double face printer includes two vacuum drums which are rotatable, and two ink-jet heads which are arranged facing the two vacuum drums respectively. A mechanism for attaching the printing paper (printing medium) is provided to each of the vacuum drums. Concretely, a plurality of holes is provided in an outer peripheral surface of each of the vacuum drums, and the plurality of holes communicates with a plurality of air chambers provided in the drums. Moreover, the plurality of air chambers is provided with a plurality of valves for switching between communicating condition and cut-off condition with a suction source. Therefore, it is possible to generate a vacuum condition independently for each of the plurality of air chambers by the plurality of valves, and to attach the printing paper to a predetermined area of the outer peripheral surface of the vacuum drums.

In this double face printer, firstly, while the printing paper is attached to one of the vacuum drums to hold the printing paper, and while the vacuum drum is rotated, printing is carried out on one surface (front surface) of the printing paper by one of the ink-jet heads facing this vacuum drum. Next, the printing paper having the front surface printed is passed on to the other vacuum drum while turning over the printing paper. Furthermore, while the printing paper is attached to the other vacuum drum and while the other vacuum drum is rotated, printing is carried out on the other surface (rear surface) of the printing paper by the other ink-jet head facing this vacuum drum.

SUMMARY OF THE INVENTION

In the double face printer in which the front surface and the rear surface of the printing medium are turned over by the switch back mechanism, at the time of switch back, the printing medium assumes a non-restraint state (free state) instantaneously. At this time, the printing medium is susceptible to jamming due to curling. Particularly, in a case in which the printing head is an ink-jet head, when ink is jetted only on one surface of the printing medium, a substantial curling of the printing medium is susceptible to occur till the ink has dried completely, and the abovementioned problems is susceptible to arise.

In the printer in which the printing medium is transported while being attached to and held by the vacuum drum, and the printing medium is turned over while passing between the two vacuum drums, a force constraining the printing medium is higher as compared to a force in the switch back type. Therefore, the problem of jamming due to the curling of the printing medium hardly occurs. However, in this double face printer, it is necessary to arrange the two ink-jet heads to face the two vacuum drums, respectively, in order for printing on the front surface and the rear surface of the printing medium respectively. Therefore, there is an increase in the number of components leading to an increase in a cost, and moreover, it becomes difficult to make the printer small.

An object of the present invention is to provide printer in which double face printing is possible, and in which it is possible to suppress the curling of the printing medium by a structure simpler than the conventional structure.

According to an aspect of the present invention, there is provided a printer which jets an ink onto a printing medium to perform printing, including:

a first rotatable body which has an outer peripheral surface;

a first rotational drive mechanism which drives the first rotatable body to rotate;

a first attaching mechanism which makes the printing medium to be attached to the outer peripheral surface of the first rotatable body;

an ink-jet head which is arranged to face the outer peripheral surface of the first rotatable body, and which performs the printing by jetting the ink onto the printing medium attached to the outer peripheral surface of the first rotatable body;

a second rotatable body which has an outer peripheral surface and which is arranged to be near to the first rotatable body to face the first rotatable body;

a second rotational drive mechanism which drives the second rotatable body to rotate;

a second attaching mechanism which makes the printing medium to be attached to an outer peripheral surface of the second rotatable body;

a transfer mechanism which transfers the printing medium between the first and second rotatable bodies, and which has a first transfer path and a second transfer path, the first transfer path connecting the first rotatable body and the second rotatable body, and running through a facing area, which is located between the first rotatable body and the second rotatable body and at which the first rotatable body faces the second rotatable body, and the second transfer path connecting the first rotatable body and the second rotatable body, without running through the facing area; and a transporting control mechanism controlling the first and second rotational drive mechanisms to transfer the printing medium having a front surface for which the printing has been performed by the ink-jet head, from one rotatable body of the first and second rotatable bodies to the other rotatable body of the first and second rotatable bodies, via the first transfer path of the transfer mechanism; and to transfer the printing medium having the printed front surface from the other rotatable body to the one rotatable body, via the second transfer path of the transfer mechanism.

According to the printer of the present invention, it is possible to carry out the following operation for example. Printing is carried out on the front surface of the printing medium by jetting the ink from the ink-jet head on to the front surface of the printing medium attached to and held on (by) the first rotatable body (such as a first drum) by the first attaching mechanism. Moreover, the printing medium having the first surface printed, in a state of being attached to and held by the first drum, is transported by rotating the first drum by the first rotational drive mechanism, and then transferred to the second rotatable body (such as a second drum) by the transfer mechanism.

Next, the printing medium in a state of being attached to and held by the second drum by the second attaching mechanism is transported by rotating the second drum by the second rotational drive mechanism, and then returned once again to the first drum by the transfer mechanism. Here, the front surface and the rear surface of the printing medium are turned over at the time of transferring the printing paper between the first drum and the second drum, and the printing medium is transferred to the first drum from the second drum in a state of the front surface printed earlier, and the surface on the opposite side (the rear surface) being exposed. Moreover, the printing on the rear surface of the printing medium is carried out by jetting the ink from the ink-jet head on to the printing medium.

In this manner, according to the present invention, since the front surface and the rear surface of the printing medium are turned over while restraining the printing medium by attaching to the first rotatable body and the second rotatable body such as the first drum and the second drum, it is possible to suppress the curling of the printing medium during transporting and at the time of turning over the front surface and the rear surface. Furthermore, it is possible to return the printing medium having the front surface printed at the first rotatable body, to the first rotatable body facing the ink-jet head upon turning over the front surface and the rear surface by transferring between the first rotatable body and the second rotatable body. Accordingly, it is possible to print both the front surface and the rear surface of the printing medium by the ink-jet head facing the first drum. Consequently, it is possible to carry out double face printing while suppressing the curling of the printing medium by a comparatively simpler structure.

BRIEF DESCRIPTION OF THE DRAWINGS

FIG. 3A shows a drum in which through holes are formed around entire periphery of the drum, and FIG. 3B shows a drum in which the through holes are not provided in a partial area of an outer peripheral surface of the drum;

DETAILED DESCRIPTION OF THE PREFERRED EMBODIMENTS

Figure 1:
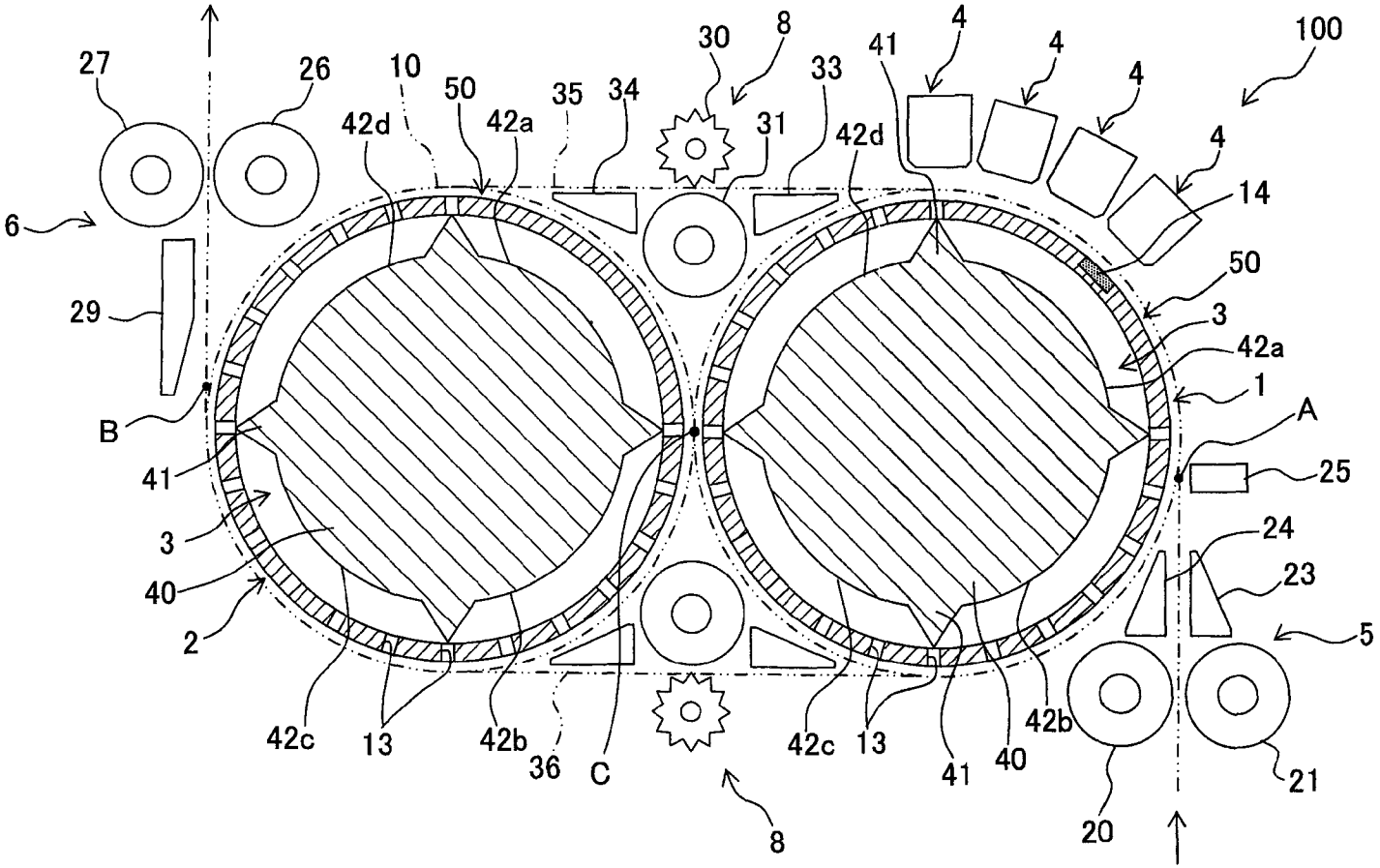
FIG. 1 is a schematic structural view of a printer according to a first embodiment.
Figure 2:
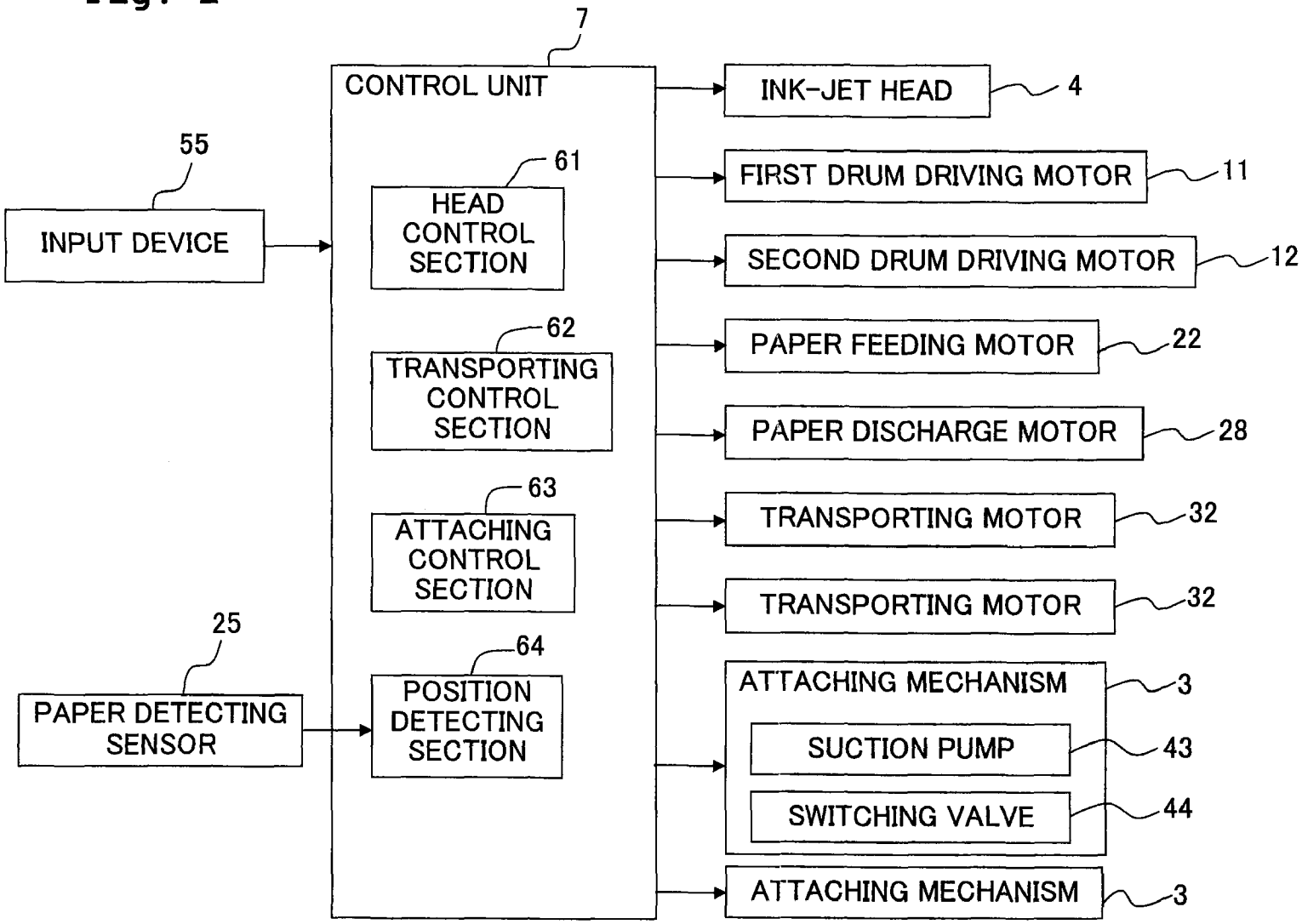
FIG. 2 is a block diagram showing schematically an electrical structure of the printer.

Exemplary embodiments of the present invention will be described below. As shown in FIGS. 1 and 2, a printer 100 of an embodiment includes two drums (a first drum 1 and a second drum 2) which are rotatable, a first drum driving motor 11 and a second drum driving motor 12 (a first rotational driving mechanism and a second rotational driving mechanism) which drive to rotate the first drum 1 and the second drum 2 respectively, two attaching mechanisms 3 (a first attaching mechanism and a second attaching mechanism) which are provided to the first drum 1 and the second drum 2 respectively, and which attach (attract) a printing paper P (a printing medium) to an outer peripheral surface of the first drum 1 and the second drum 2 respectively, four ink-jet heads 4 which is arranged to face the outer peripheral surface of the first drum 1, and which carry out printing by jetting ink on to the printing paper P, a paper feeding mechanism 5 which supplies the printing paper P to the first drum 1, a paper discharge mechanism 6 which discharges the printing paper P from the second drum 2, and a control unit 7 which totally controls the printer 100.

In the printer 100, the printing paper P is transported through a transporting path 10 shown by alternate long and short dash lines in FIG. 1. The printing paper P is turned over while transferring the printing paper P between the first drum 1 and the second drum 2. In this manner, the printing is possible on both surfaces of the printing paper P by the ink-jet head 4 facing the first drum 1. In other words, the first drum 1 has a function of a platen which supports the printing paper P on which an image or the like is printed by the ink-jet head 4. Whereas, the second drum 2 functions as a reversing drum which turns over (the front surface and the rear surface of) the printing paper P which is printed by the first drum 1. Moreover, a single face printing, in which the printing paper P is discharged without printing the rear surface thereof after the front surface of the printing paper P is printed by the ink-jet head 4, is also possible. A concrete structure of the printer 100 will be described below in detail.

As shown in FIG. 1, the two drums namely the first drum 1 and the second drum 2 are formed to be circular cylinder shaped, and are arranged to be near in a radial direction thereof. In the embodiment, a diameter of the first drum 1 is the same as a diameter of the second drum 2. The first drum 1 and the second drum 2 are rotatable in a normal direction (a clockwise direction; a CW direction) and a reverse direction (a counterclockwise direction; a CCW direction). The first and second drums 1, 2 are driven to rotate by the drum driving motors 11 and 12 respectively. Moreover, a plurality of through holes 13 aligned in a circumferential direction are formed in each of the drums (each of the first drum 1 and the second drum 2), and an inner-side space (an internal space) of the first drum 1 and the second drum 2 communicate with an atmosphere via the through holes 13. The attaching mechanisms 3 which will be described later are provided in the inner side space of the first drum 1 and the second drum 2 respectively. When the first drum 1 and the second drum 2 rotate while the printing paper P is attached to an outer peripheral surface by the attaching mechanism 3, the printing paper P is transported in the circumferential direction of the first drum 1 and the second drum 2.

An ink receiving member 14 which receives ink jetted from nozzles at the time of carrying out flushing of the nozzles of the ink-jet head 4 which will be described later is provided on a part of the external peripheral surface of the first drum 1.

A paper feeding mechanism 5 which supplies the printing paper P toward the first drum 1 is provided at a predetermined position on a tangent of the first drum 1. The paper feeding mechanism 5 includes a paper feeding roller 20, a nip roller 21 which is arranged to face the paper feeding roller 20, and to sandwich the printing paper P between the feeding roller 20 and the nip roller 21, a paper feeding motor 22 (refer to FIG. 2) which drives to rotate the paper feeding roller 20, and paper feeding guides 23 and 24. The printing paper P pinched by the paper feeding roller 20 and the nip roller 21 is supplied to the first drum 1 via the paper feeding guides 23 and 24. A paper detecting sensor 25 which detects whether the printing paper P has been supplied or not is provided at a paper feeding position (position A in FIG. 1) at which the printing paper P is supplied to the first drum 1 from the paper feeding mechanism 5.

Moreover, a paper discharge mechanism 6 which discharges the printing paper P which is transported by the second drum 2 is provided at a predetermined position on a tangent of the second drum 2. The paper discharge mechanism 6 includes a paper discharge roller 26, a nip roller 27 which is arranged to face the paper discharge roller 26, and to sandwich (pinch) the printing paper P between the paper discharge roller 26 and the nip roller 27, a paper discharge motor 28 (refer to FIG. 2) which drives to rotate the paper discharge roller 26, and a paper discharge guide 29. The printing paper P which is sent from the second drum 2 via the paper discharge guide 29 is pinched by the paper discharge roller 26 and the nip roller 27, and is discharged.

As shown in FIG. 1, a paper feeding position A (supply position) at which the printing paper P is supplied by the paper supply feeding mechanism 5, and a paper discharge position B (discharge position) at which the printing paper P is discharged by the paper discharge mechanism 6 are symmetrical with respect to a nearest point C of the first drum 1 and the second drum 2. Moreover, a direction in which the printing paper P is supplied to the first drum 1 by the paper feeding mechanism 5 and a direction in which the printing paper P is discharged from the second drum 2 by the paper discharge mechanism 6 are tangential directions of drum, and are directed in a same direction (upward direction in FIG. 1). By adopting such layout, it is possible to arrange the first drum 1, the second drum 2, the paper feeding mechanism 5, and the paper discharge mechanism 6 compactly.

Two holding mechanisms 8 which hold the printing paper P which is transferred between the first drum 1 and the second drum 2 are provided on two external common tangents 35 and 36 extending between the first drum 1 and the second drum 2. The two holding mechanisms 8 have the same structure. In other words, each holding mechanism 8 includes a first transporting roller 20 (a first roller) having a plurality of protrusions aligned in a circumferential direction; a second transporting roller 31 (a second roller) having a circular cylindrical shape, facing the first transporting roller 30 and pinching the printing paper P between the first and second transporting rollers; a transporting motor 32 which drives to rotate the second transporting roller 31; and paper transporting guides 33 and 34 which are arranged on two sides respectively in a transporting direction (left-right direction in FIG. 1) of the pair of rollers including the first transporting roller 30 and the second transporting roller 31.

When the printing paper P is transferred on the external common tangents 35 and 36 of the first drum 1 and the second drum 2, the printing paper P is detached (separated) from the first drum 1 and the second drum 2 instantaneously. Therefore, a force of constraint is decreased, and warping (curling) of the printing paper P is susceptible to occur. Therefore, when the printing paper P is transferred between the first drum 1 and the second drum 2, the holding mechanism 8 restricts the printing paper P by pinching between the first transporting roller 30 and the second transporting roller 31, and holds the printing paper P assuredly.

When the printing paper P is transferred from the first drum 1 to the second drum 2 on the external common tangents 35 and 36, a surface of the printing paper P which is printed immediately before transferring faces an outer side with respect to the two external common tangents 35 and 36 (opposite side of the first drum 1 and the second drum 2). Moreover, in the embodiment, the first transporting roller 30 having the plurality of protrusions is arranged on an outer side of the external common tangents 35 and 36. In other words, immediately after the printing, a surface of the printing paper P makes a contact with the first transporting roller 30 with a small contacting area. Therefore, it is possible to transport the printing paper P while preventing the printed surface from being stained.

The four ink-jet heads 4 face the outer peripheral surface of the first drum 1, and jet inks of four colors (namely, yellow, magenta, cyan, and black) onto the printing paper P which is transported by the first drum 1. The ink-jet head 4 is not restricted to be an ink-jet head of a specific type. For instance, the ink-jet head 4 may be a so-called line head which has a plurality of nozzles arranged in a row over almost entire area in a width direction of the printing paper P (direction perpendicular to paper surface in FIG. 1), and which carries out printing statically by jetting the inks from the plurality of nozzles at a fixed position. Or, the ink-jet head 4 may be a so-called serial head which carries out printing by jetting the inks from the nozzles while reciprocating in the width direction of the printing paper P.

Since the two attaching mechanisms 3 (the first attaching mechanism and the second attaching mechanism) provided to the first drum 1 and the second drum 2 have the same structure, one of the attaching mechanisms 3 provided to the first drum 1 will be described below.

The attaching mechanism 3 includes, in the first drum 1, a fixed body 40 in the form of a column arranged with a gap from an inner surface of the first drum 1. The fixed body 40 is fixed to a frame of the printer 100, which is not shown in the diagram. The first drum 1 positioned at an outer side of the fixed body 40 rotates relatively to the fixed body 40.

Four partition walls 41 provided with an equal gap (interval) (angular interval of 90°) in a circumferential direction of the fixed body 40 are provided to an outer peripheral surface of the fixed body 40, and a front end of each of the partition walls 41 makes a sliding contact with the inner surface of the first drum 1. Moreover, a space between the first drum 1 and the fixed body 40 is divided into four cells in a circumferential direction by the four partition walls 41. Accordingly, four decompression chambers 42 (42*a*, 42*b*, 42*c*, and 42*d*) having a shape of ¼ circular arc are formed. In FIG. 1, an example in which the four partition walls 41 are formed integrally with the fixed body 40 is shown. However, the partition walls 41 may be formed of a member other than the fixed body 40, and may be fixed to the outer peripheral surface of the fixed body 40.

The four decompression chambers 42 are connected to a suction pump 43 as a suction source (decompression mechanism: refer to FIG. 2). Moreover, four switching valves 44 (such as solenoid valves) which connect/disconnect the four decompression chambers 42 and the suction pump 43, independently, (a communicating condition/a cut-off condition) are provided. Since the four decompression chambers 42 and the suction pump 43 can be connected/disconnected by the four switching valves 44, independently, the suction pump 43 is capable of decompressing independently each of the four decompression chambers 42.

Incidentally, as mentioned above, as shown in FIG. 1, the plurality of through holes 13 aligned at an interval in the circumferential direction are formed in the first drum 1 (the second drum 2). Moreover, not less than two through holes 13 among the through holes 13 are lined up in an area (¼ circular arc area) of the first drum 1, between two points making a contact with the two partition walls 41. In other words, at least two through holes 13 communicate with one decompression chamber 42 demarcated by the two partition walls 41. Accordingly, when the printing paper P is located on the outer peripheral surface of the first drum 1 and the second drum 2, and when a certain decompression chamber 42 is decompressed (is sucked) by the suction pump 43, the printing paper P is attracted to the plurality of through holes 13 communicating with the decompression chamber 42. In this manner, since the plurality of through holes 13 are communicated with one of the decompression chambers 42, it is possible to make attach the printing paper P at the plurality of through holes 13 simultaneously by decompression of the one of the decompression chambers 42, and it is possible to hold the printing paper P assuredly. Moreover, there is also an advantage that the structure becomes simple as compared to a case in which decompression chambers 42 correspond one-to-one with the through holes 13 and a suction of the decompression chambers 42 is controlled independently.

When the first drum 1 and the second drum 2 are rotated while the printing paper P are attached to the attaching mechanism 3, it is possible to transport the printing paper P along the circumferential direction of the first drum 1 and the second drum 2 with the printing paper P being attached thereon, and to suppress the warping (curling) of the printing paper P during transporting. Moreover, since it is possible to switch independently the decompression state and the compression state of the four decompression chambers 42, it is possible to select an area, of the outer peripheral surface of the first drum 1 and the second drum 2, to which the printing paper P is to be attached. Accordingly, when the decompression chamber 42, in the first drum 1 and the second drum 2, to be decompressed is selected appropriately, it is possible to transfer the printing paper P between the first drum 1 and the second drum 2. The transfer of the printing paper P between the first drum 1 and the second drum 2 will be described later concretely.

As shown in FIG. 1, a partial area 50 in which the through holes 13 are not formed is provided on the outer peripheral surface of the first drum 1 (the second drum 2), and a length of the partial area 50 in a circumferential direction is equal to or more than a length, in the circumferential direction (a circular arc area of a central angle of 90°), of the first drum 1 and the second drum 2 corresponding to one of the decompression chambers 42. When a certain through hole 13 which is closed by a front end portion of the printing paper P and another through hole 13 which is open are communicated with a same decompression chamber 42, an attaching force acting on a front end portion of the printing paper P decreases. This structure is adopted for preventing the decrease in the attaching force acting on the front end portion of the printing paper P. Details of the structure will be described later. Moreover, the ink receiving member 14 mentioned above is provided to the partial area 50 of the first drum 1, in which the through holes 13 are not formed. The ink receiving member 14 is capable of receiving ink which is jetted when the flushing of the nozzles of the ink-jet head 4 is carried out. An arrangement of the through holes 13 in the surface of the first drum 1 and the second drum 2, in an extending direction (axial direction) of the first drum 1 and the second drum 2 may be arbitrary. It is desirable that the through holes 13 are arranged to correspond to the maximum size of the paper that may be used, or that the through holes 13 are arranged to correspond to a size of a paper that is considered to be used most frequently.

Next, an electrical structure of the printer 100 such as the control unit 7 is described below with reference to FIG. 2. The control unit 7 shown in FIG. 2 may include components such as a central processing unit (CPU), a read only memory (ROM) in which various computer programs and data for controlling an overall operation of the printer 100 are stored, and a random access memory (RAM) which temporarily stores data or the like to be processed by the CPU. When a computer program stored in the ROM is executed by the CPU, various controls described below may be carried out by software. Or, the control unit 7 may realize a predetermined control by hardware in which various circuit including an arithmetic circuit are combined.

The control unit 7 includes a head control section 61, a transporting control section 62 (a transporting control mechanism), an attaching control section 63, and a position detecting section 64 (a position detecting mechanism). The head control section 61 control the ink-jet head 4 to jet an ink toward the printing paper P to print a desired image on the printing paper P, based on printing data input from an input unit (an input device) 55 such as a personal computer (PC). Moreover, the transporting control section 62 controls the first drum driving motor 11 which drives to rotate the first drum 1, the second drum driving motor 12 which drives to rotate the second drum 2, the paper feeding motor 22 of the paper feeding mechanism 5, the paper discharge motor 28 of the paper discharge mechanism 6, and the transporting motor 32 of the two holding mechanisms 8, in order to transport the printing paper P to the first drum 1 and the second drum 2. A concrete control of transporting by the transporting control section 62 will be described later in detail.

The attaching control section 63 controls the suction pump 43 and the switching valve 44 of the two attaching mechanisms 3 to attach the printing paper P to the first drum 1 or the second drum 2, and to transfer the printing paper P between the first drum 1 and the second drum 2.

Here, the transfer of the printing paper P between the first drum 1 and the second drum 2 by controlling the attaching mechanism 3 will be explained. At the time of carrying out the transfer, the attaching control section 63 controls one of the drums at an origin of transfer to detach (separate) the printing paper P from the drum by lowering the attaching force (suction force) of the one drum, and controls the other drum at a destination of transfer to attach the printing paper P separated from the drum at the origin of transfer, by increasing the attaching force of the other drum.

More concretely, firstly, while both the first drum 1 and the second drum 2 rotate, one of the decompression chambers 42 (42*a* to 42*d*), formed in one drum at the origin of transfer, corresponding to an area for separating the front end portion of the printing paper P is disconnected from the suction pump 43 by the switching valve 44. Accordingly, a decompressed state of this decompression chamber 42 is released, the front end portion of the printing paper P is separated from the one drum at the origin of transfer. At the same time, one of the decompression chambers 42, formed in the other drum at the destination of transfer, corresponding to an area of receiving the front end portion of the printing paper P is connected to the suction pump 43 by the switching valve 44. Accordingly, the front end portion of the printing paper P which is separated from the one drum at the origin of transfer can be attached by making the decompression chamber 42 to be in a decompressed state. Accordingly, the printing paper P is transferred to the other drum at the destination of transfer.

In other words, in the embodiment, the attaching control section 63, which controls the two attaching mechanisms 3 independently, corresponds to the transfer mechanism. According to this structure, it is possible to transfer the printing paper P when the two attaching mechanisms 3 are controlled just to change the attaching force of the first drum 1 and the second drum 2. Therefore, a separate member for transfer is not necessary, and the structure becomes simple. Moreover, the attaching mechanism 3 includes the four decompression chambers 42*a* to 42*d* divided in the circumferential direction of the first drum 1 and the second drum 2, and the four switching valves 44 corresponding to the four decompression chambers 42*a* to 42*d*, and it is possible to decompress the four decompression chambers 42*a* to 42*d* independently by the suction pump 43. Accordingly, since it is possible to selectively attach/detach the printing paper P to/from the partial area in the circumferential direction of the outer peripheral surface of the first drum 1 and the second drum 2, a smooth transfer of the printing paper P between the first drum 1 and the second drum 2 is possible.

The position detecting section 64 detects a position of the front end of the printing paper P during transporting based on a paper feeding timing at which the printing paper P detected by the paper detecting sensor 25 is supplied to the first drum 1, and information related to the number of rotations (rotational frequency) of the first drum 1 and the second drum 2. In this manner, it is indispensable to find the position of the front end of the printing paper P for carrying out printing by the ink-jet head 4. However, in the embodiment, a detection result of the position detecting section 64 is used for the following purpose other than printing.

Figure 3A:
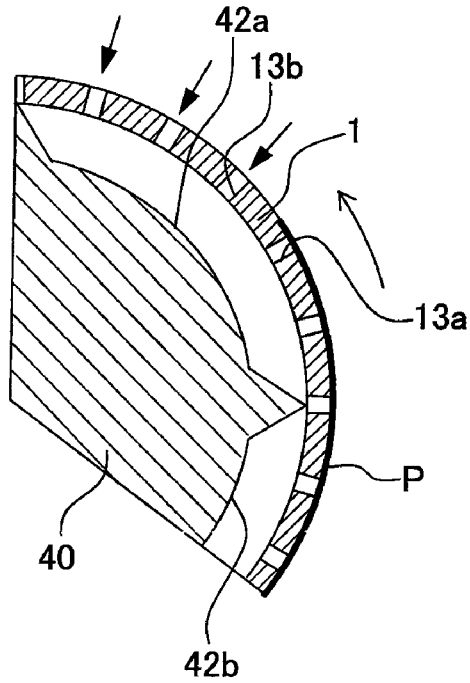
FIGS. 3A and 3B are enlarged views of an outer peripheral portion of a drum.

The following description is made by citing an example of the first drum, and the description is similar for the second drum 2. As it has been described above, the plurality of through holes 13 communicate with one decompression chamber 42. Assume that, as shown in FIG. 3A, the front end portion of the printing paper P covers the through hole 13 (13*a*) through which the printing paper P is sucked, and that a through hole 13*b*, which is formed adjacent to the closed through hole 13*a* in a rotational direction (direction of an arrow) of the first drum 1, is open, not closed by the printing paper P. In this case, the through hole 13*a* closed by the printing paper P and the through hole 13*b* in the open condition communicate with the same decompression chamber 42*a*. In this case, even when the decompression chamber 42*a* is decompressed, an atmosphere flows into the decompression chamber 42*a* via the open through hole 13*b*. Therefore, the decompression chamber 42*a* is hard to be decompressed, and the attaching force acting on the front end portion of the printing paper P decreases.

Figure 3B:
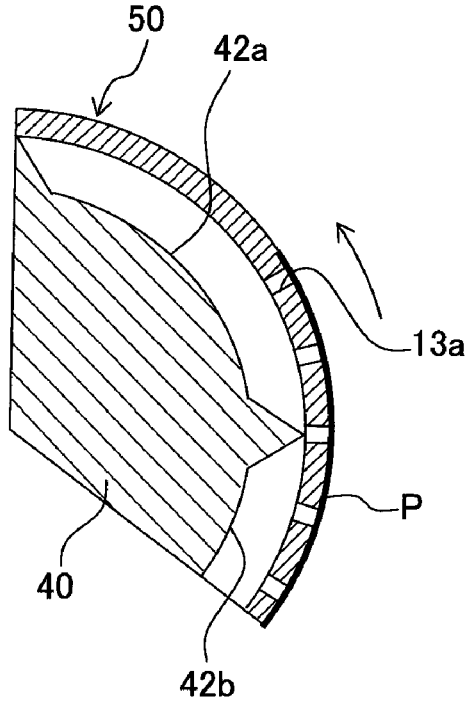

Therefore, in the embodiment, to solve problems such as the abovementioned problem, the following structure has been adopted. As shown in FIG. 1, the partial area 50 in which the through holes 13 are not formed is provided on the outer peripheral surface of the first drum 1 (the second drum 2), and the length of the partial area 50 in the circumferential direction is equal to or more than the length of the first drum 1 corresponding to one decompression chamber 42 in the circumferential direction (the circular arc area of a central angle of 90°). The first drum driving motor 11 is controlled based on the position of the front end of the printing paper P detected by the position detecting section 64 such that, the front end portion of the printing paper P is attached to the through hole 13*a* which is nearest to the partial area 50, in a reverse-rotation direction opposite to the rotation direction of the first drum 1, as in FIG. 3B. Accordingly, it is possible to avoid both the closed through hole 13*a* which is closed by the front end portion of the printing paper P and the open through hole 13*b* which is open communicate with the same decompression chamber 42, and it is possible to prevent the decrease in the attaching force acting on the front end portion of the printing paper P.

In the printer 100 of the embodiment, it is possible to carry out a double face printing mode and a single face printing mode, selectively. In the double face printing mode, after the ink-jet head 4 performs printing on one surface (front surface) of the printing paper P, the printing paper P is turned over, and the ink-jet head 4 also performs printing on the other surface (rear surface) of the printing paper P. In the single face printing mode, after the ink-jet head 4 performs printing on the front surface of the printing paper P, the printing paper P is discharged without being printed on the rear surface thereof. A series of controls of the printer 100 (such as a transporting control of the printing paper P) in the double face printing mode and the single face printing mode will be described below.

Double Face Printing Mode

Figure 4:
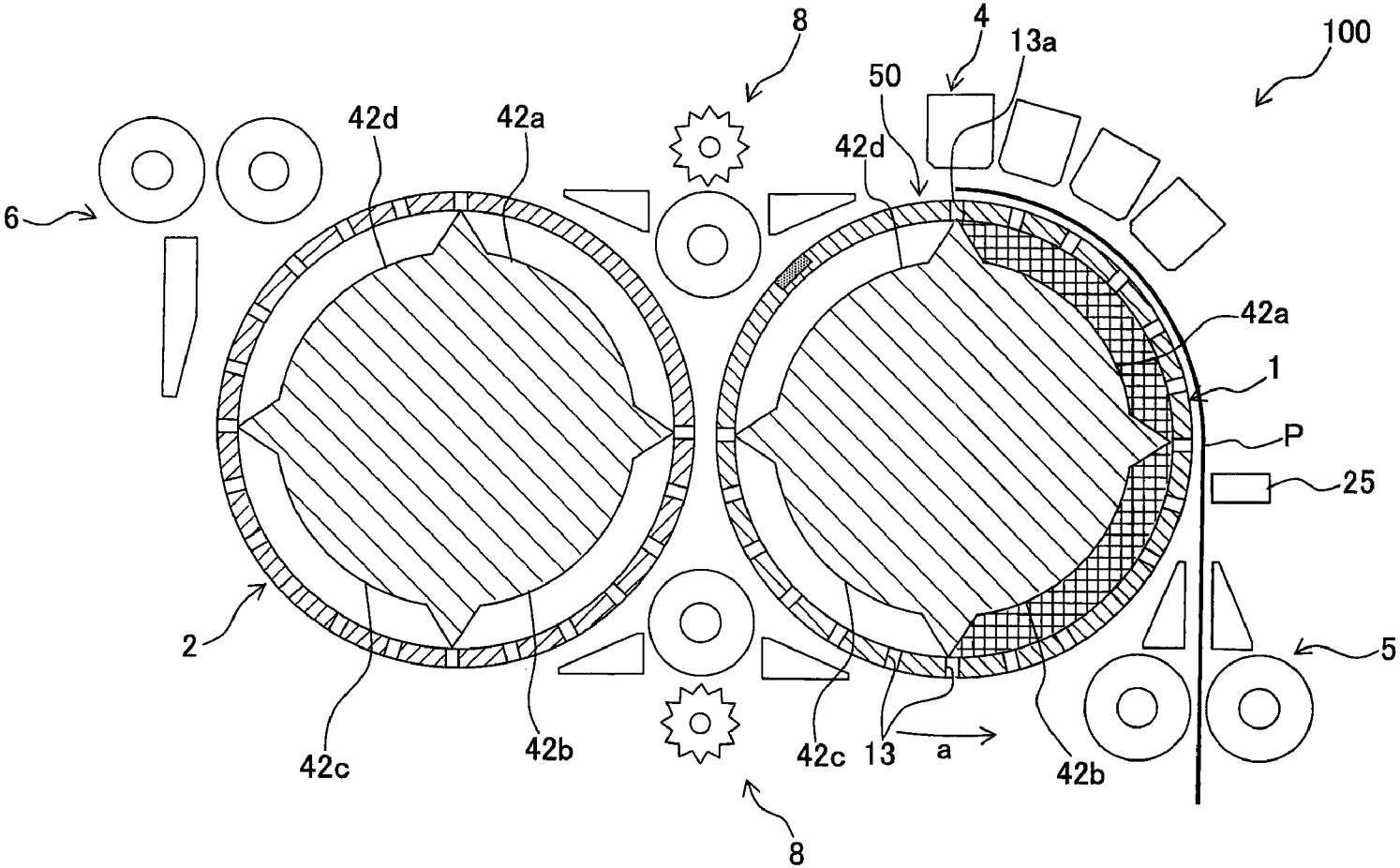
FIG. 4 is a diagram showing an operation of the printer (paper feeding and front-surface printing) when a double face printing mode is selected.

The double face printing mode will be described with reference to FIGS. 4 to 9. As shown in FIG. 4, firstly, as the printing paper P supplied from the paper feeding mechanism 5 is detected by the paper detecting sensor 25, the control unit 7 controls the attaching mechanism 3 to decompress the decompression chambers 42*a* and 42*b* to attach the front end portion of the printing paper P to the first drum 1. At this time, the other decompression chambers 42*c* and 42*d* are not decompressed. In FIG. 4, the hatched decompression chamber 42 shows that the decompression chamber 42 is decompressed (similar even in the following description).

Moreover, the transporting control section 62 controls the rotation of the first drum 1 (the rotational drive by the first drum driving motor 11) based on the position of the front end portion of the printing paper P detected by the position detecting section 64, such that the front end portion of the printing paper P is attached to the through hole 13*a* which is most adjacent, in the reverse rotation direction (direction of arrow a; arrow-a direction), to the partial area 50 of the first drum 1 in which the through holes 13 are not formed. The control for attaching the front end portion of the printing paper P to a predetermined position is carried out all the time when the drum (any one of the first drum 1 and the second drum 2) receives the printing paper P, for maintaining the attaching force acting on the front end portion of the printing paper P. Therefore, the description of the abovementioned control is omitted appropriately in the following description.

Thereafter, the transporting control section 62 controls the first drum driving motor 11 to rotate the first drum 1 in the counterclockwise direction (direction of arrow a) while the printing paper P is attached to the first drum 1. Then, the printing paper P is transported up to a position facing the ink-jet head 4. At this time, printing is carried out on one surface (front surface) of the printing paper P by the ink-jet head 4.

Figure 5:
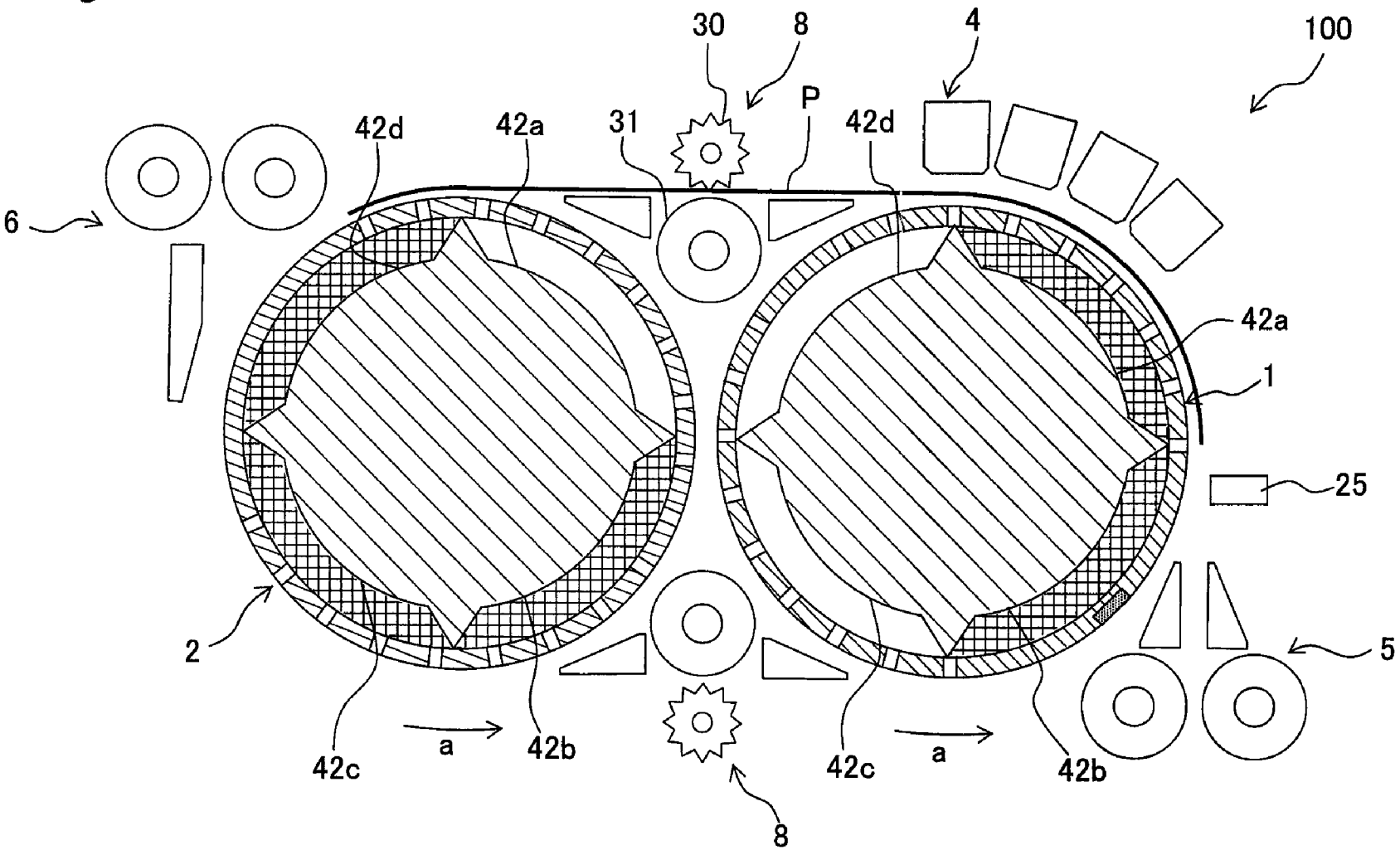
FIG. 5 is a diagram showing an operation of the printer (transfer at an external common tangent immediately after front-surface printing) when the double face printing mode is selected.

Next, while the first drum 1 rotates in the direction of arrow a, the transporting control section 62 controls the second drum driving motor 12 to rotate the second drum 2 in the same direction as the rotation direction of the first drum 1 (arrow-a direction). As the second drum 2 is rotated, as shown in FIG. 5, the printing paper P is separated from the first drum 1 at an area, of the outer peripheral surface of the first drum 1, corresponding to the decompression chamber 42*d* which has not been decompressed. Furthermore, while the printing paper P is held by the holding mechanism 8 (the first transporting roller 30 and the second transporting roller 31) positioned at one of the external common tangents (an upper side) between the first drum 1 and the second drum 2, the printing paper P is transported to the second drum 2. At the same time, the transporting control section 62 controls the attaching mechanism 3 of the second drum 2 to decompress the decompression chambers 42*b*, 42*c*, and 42*d*. Accordingly, when the front end portion of the printing paper P separated from the first drum 1 is attached to the area, of the second drum 2, corresponding to the decompression chamber 42*d*, the printing paper P is transferred from the first drum 1 to the second drum 2 through the external common tangent.

When the printing paper P is transferred through the external common tangent, the printing paper P are not turned over. In other words, the printing paper P is transferred to the second drum 2 with the front surface which is printed immediately before, exposed. Consequently, the front surface and the rear surface of the printing paper P are not turned over immediately after the printing of the front surface. Accordingly, the printing paper P is turned over after the front surface thereof is completely dried, therefore an image etc. which is printed on the front surface is prevented from being stained.

Figure 6:
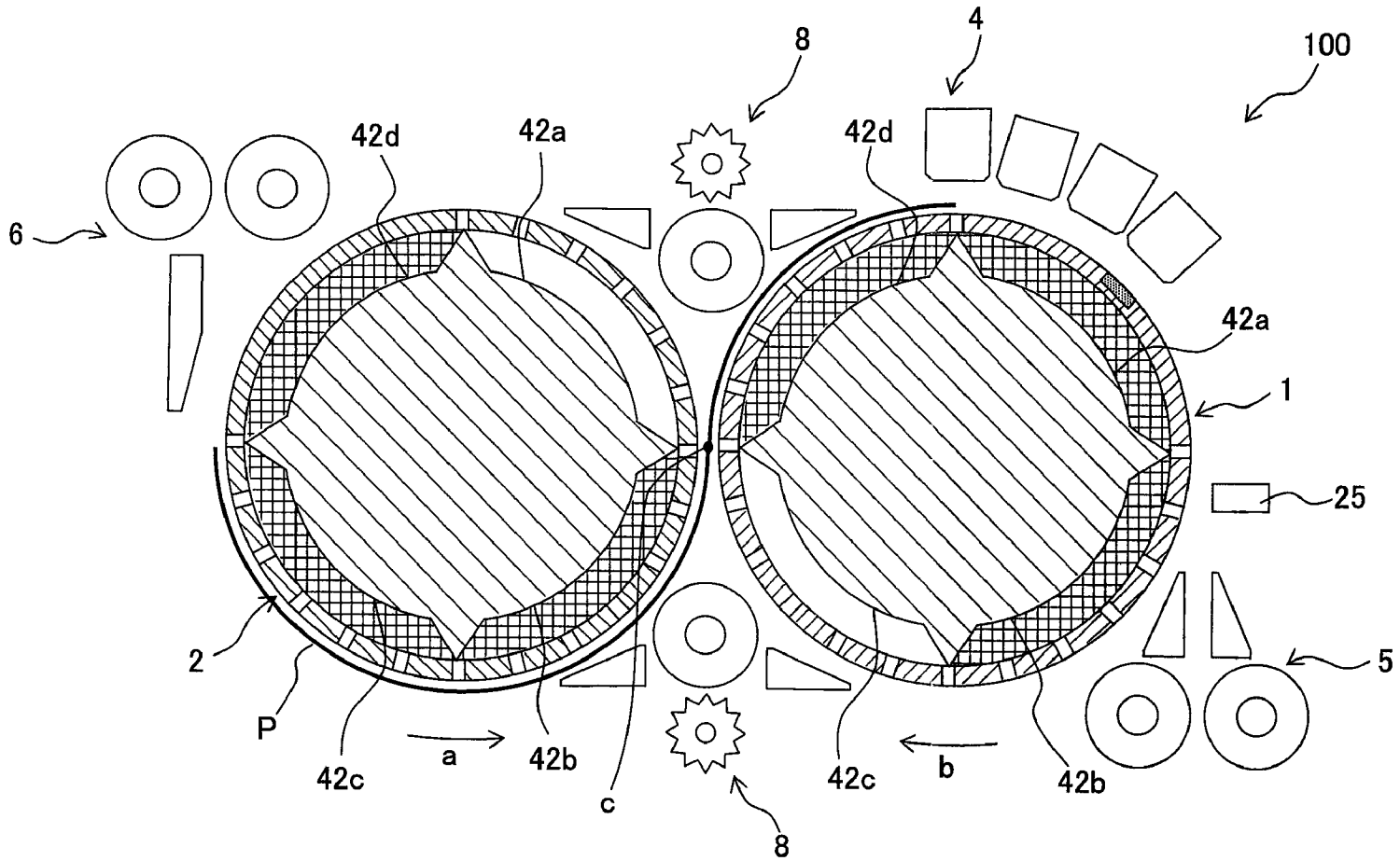
FIG. 6 is a diagram showing an operation of the printer (transfer at the nearest point) when the double face printing mode is selected.

Next, as shown in FIG. 6, while the printing paper P is attached to the second drum 2, the printing paper P is transported in the direction of arrow "a" (arrow-a direction) by rotating the second drum 2 in the arrow-a direction by the second drum driving motor 12, and the front end of the printing paper P is moved up to a nearest point C of the first drum 1 and the second drum 2. Furthermore, the compression chamber 42*d* of the first drum 1 is switched to a decompressed state, and the first drum 1 and the second drum 2 are rotated in a reverse rotation direction (direction of arrow "b"; arrow-b direction) by the first drum driving motor 11. As the first drum 1 and the second drum 2 are driven in the reverse rotation direction, the printing paper P is separated from the second drum 2, in an area of the second drum 2 corresponding to the decompression chamber 42*a* which is not decompressed. At the same time, the printing paper P which is separated from the second drum 2 is attached to an area, of the first drum 1, corresponding to the decompression chamber 42*d*. In this manner, the printing paper P is transferred from the second drum 2 to the first drum 1 at the nearest point C. When the printing paper P is transferred at the nearest point C, the printing paper P is turned over, and the printing paper P is attached to the first drum 1 such that the surface (rear surface) which is not printed is exposed.

Here, when the printing paper P is elastic, or in other words, when the printing paper P has a characteristic of making an attempt to regain original form (restoring ability) when curled, as the attaching to the first drum 1 is released, the printing paper P is separated from the surface of the first drum 1. In this case, it is possible to attach easily the front end portion of the printing paper P detached from the surface of the first drum, to the second drum 2. However, when the printing paper P is a soft paper which does not have the restoring ability as described above, even when the attaching to the first drum 1 is released, the printing paper P is in a state of being curled along the surface of the first drum 1. Even in this case, when a suction force by the second drum 2 is increased (intensified), it is possible to pull the front end portion of the printing paper P toward the second drum 2.

Figure 7:
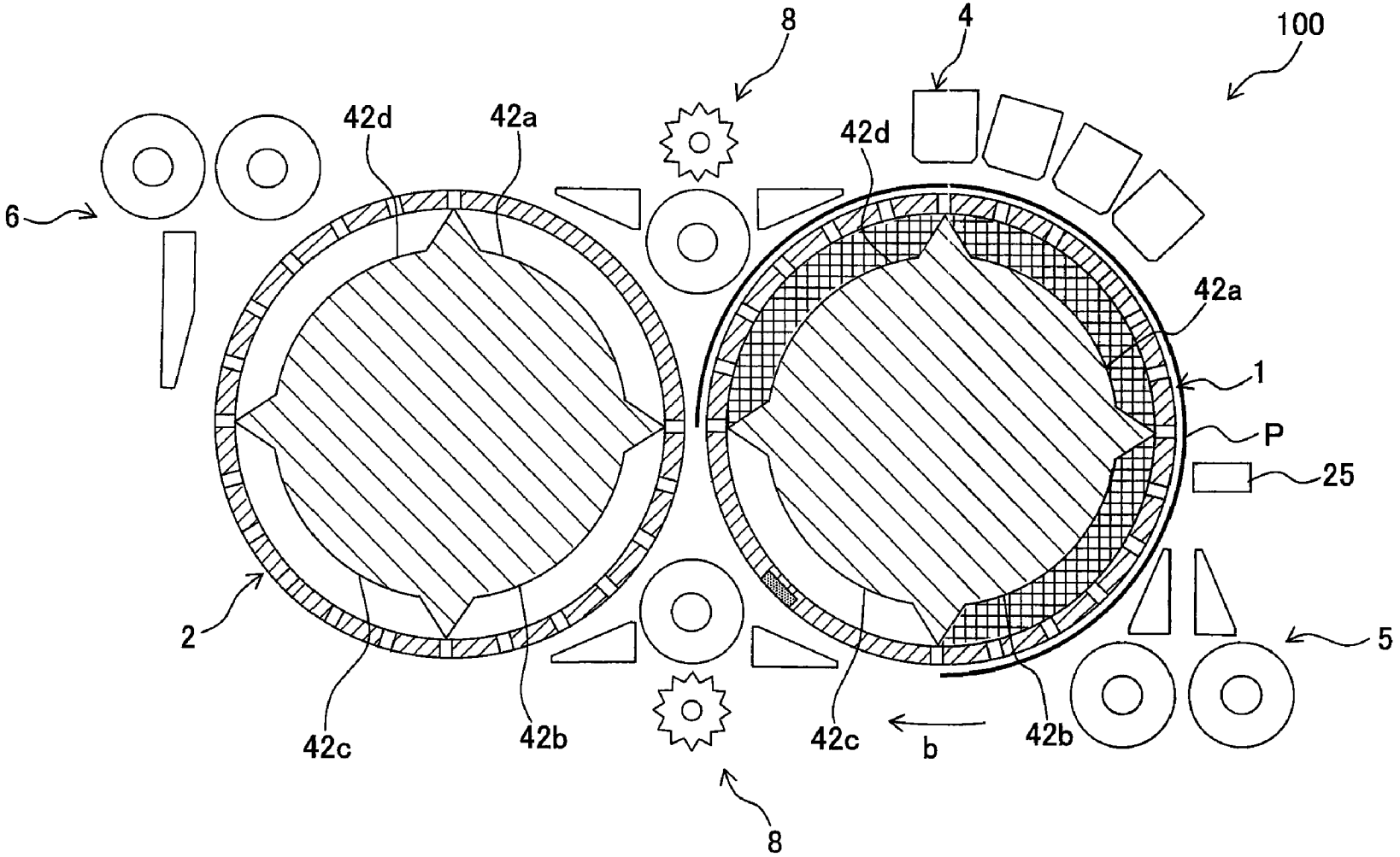
FIG. 7 is a diagram showing an operation of the printer (rear-surface printing) when the double face printing mode is selected.

Moreover, as shown in FIG. 7, while the first drum 1 is rotated in the arrow-b direction with the printing paper P being attached thereon, and while the decompressed state of the decompression chambers 42*a*, 42*b*, and 42*d* is maintained, the printing paper P which has been turned over is transported to the ink-jet head 4. At this time, the printing is carried out on the rear surface of the printing paper P by the ink-jet head 4.

Figure 8:
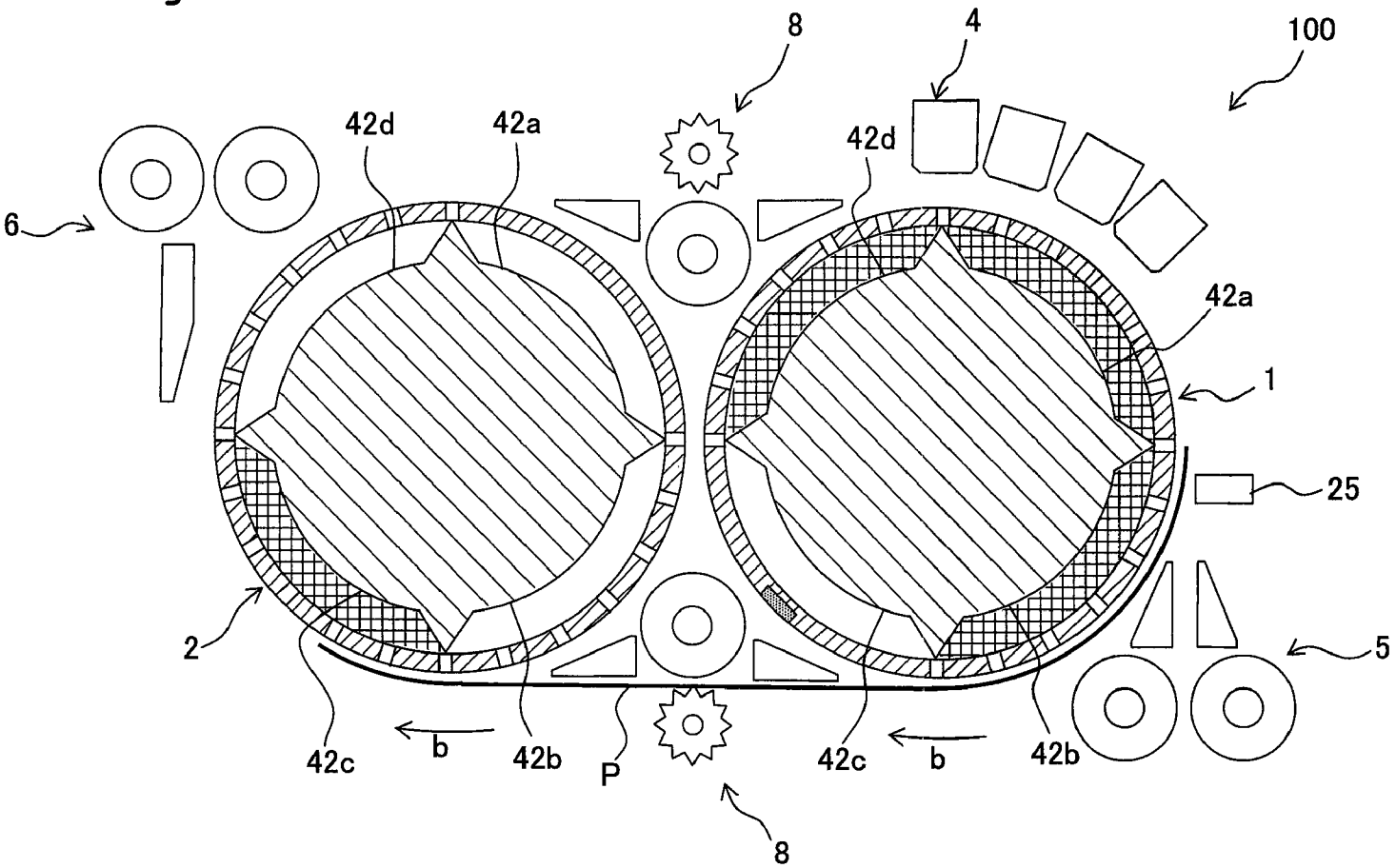
FIG. 8 is a diagram showing an operation of the printer (transfer at the external common tangent immediately after the rear-surface printing) when the double face printing mode is selected.

Next, as shown in FIG. 8, the second drum 2 is rotated in the same direction as the first drum 1 (b-direction). The printing paper P having the rear surface printed is transferred to the second drum 2 while being held by the holding mechanism 8, at the other external common tangent of the first drum 1 and the second drum 2 (lower side). An operation of switching to the decompressed state of the decompression chamber 42 at this time is same as the transfer described in FIG. 5. Therefore, the description thereof is omitted.

Figure 9:
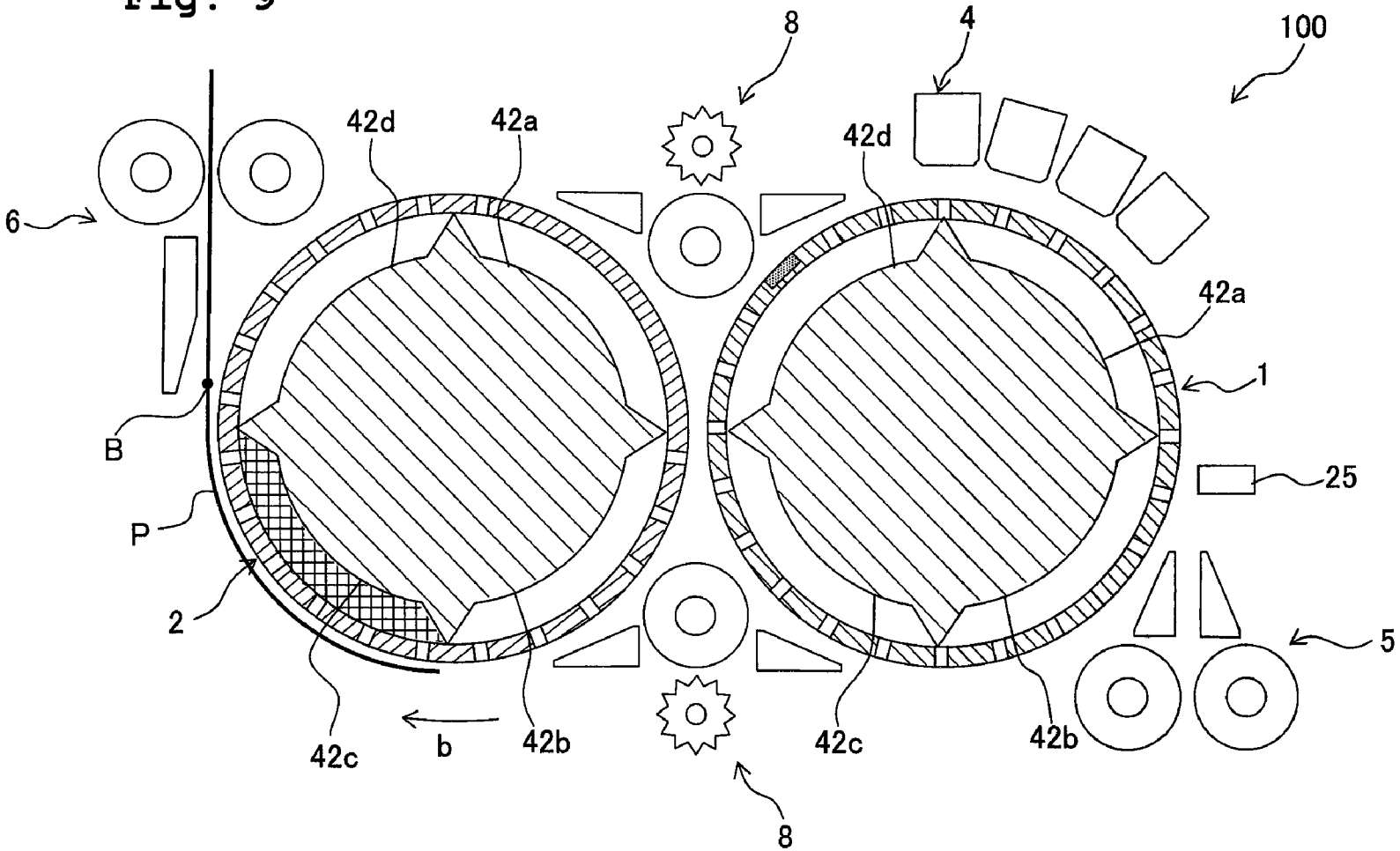
FIG. 9 is a diagram showing an operation of the printer (paper discharge) when the double face printing mode is selected.

Finally, as shown in FIG. 9, after the printing paper P is transported up to a position near the paper discharge mechanism (paper discharge position B), the printing paper P is separated from the second drum 2 at an area corresponding to the decompression chamber 42*d* which is not decompressed, and the printing paper P having the both surfaces printed is discharged from the second drum 2 by the paper discharge mechanism 6.

Incidentally, when the abovementioned transporting path of the printing paper P is used, a curling in two directions acting on the printing paper P (a curling in a direction of forming a projection on one surface side (front surface side), and a curling in a direction of forming a recess on the other surface side (rear surface)) is exerted evenly during transporting of the printing paper. In other words, the curling in the direction of forming a projection toward the front surface side which acts on the printing paper P before the printing paper P is turned over acts while the printing paper P makes one revolution around the first drum 1 and the second drum 2 (total one revolution). Concretely, as it is evident from FIGS. 4 to 6, while the printing paper P undergoes ¼ revolution around the first drum 1 (area corresponding to the decompression chamber 42*a*), and while the printing paper P undergoes ¾ revolution around the second drum 2 (area corresponding to the decompression chambers 42*b*, 42*c*, and 42*d*), the curling in the direction of forming a projection toward the front surface side acts on the printing paper P. Whereas, the bending in the direction of forming a projection toward the rear surface side which acts on the printing paper P after the printing paper P is turned over also acts while the printing paper P undergoes one revolution around the first drum 1 and the second drum 2 (total one revolution). Concretely, as it is evident from FIGS. 6 to 9, while the printing paper P undergoes ¾ revolution around the first drum 1 (area corresponding to decompression chambers 42*a*, 42*b*, and 42*c*), and while the printing paper P undergoes ¼ revolution around the second drum 2 (area corresponding to the decompression chamber 42*d*), the curling in the direction of forming a projection toward the rear side surface acts on the printing paper P. In this manner, it is possible to suppress the curling of the printing paper P by the bending in the two opposite directions being acted evenly on the printing paper P.

Single Face Printing Mode

Figure 10:
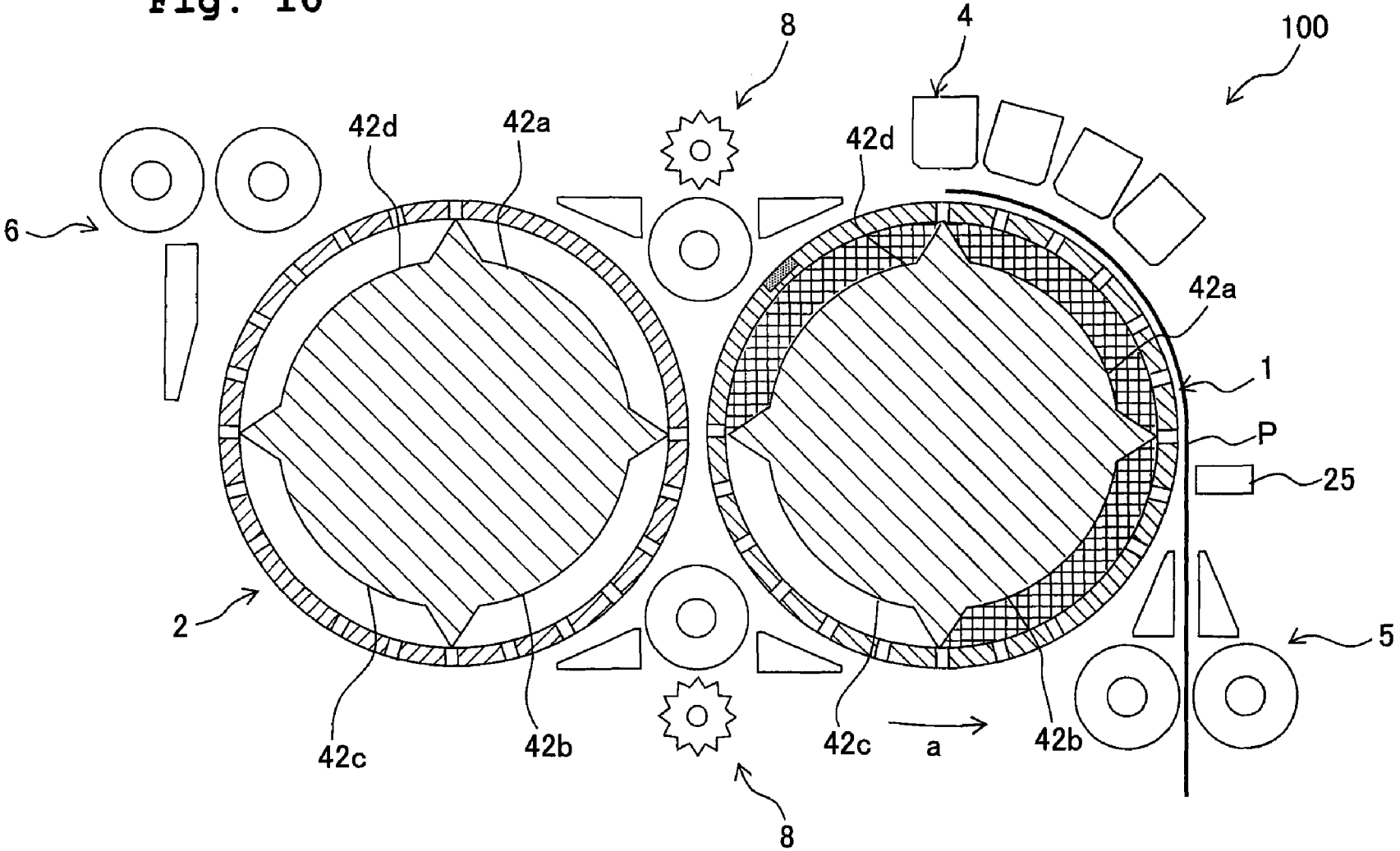
FIG. 10 is a diagram showing an operation of the printer (paper feeding and front-surface printing) when a single face printing mode is selected.

Next, the single face printing mode will be described below with reference to FIGS. 10 to 12. Firstly, as shown in FIG. 10, the decompression chambers 42*a*, 42*b*, and 42*d* in the first drum 1 are decompressed, and the printing paper P supplied from the paper feeding mechanism 5 is attached to the first drum 1. Simultaneously, the first drum 1 is rotated in the arrow-a direction, and the printing paper P is transported. Furthermore, the printing is carried out on one surface (front surface) of the printing paper P by the ink-jet head 4.

Figure 11:
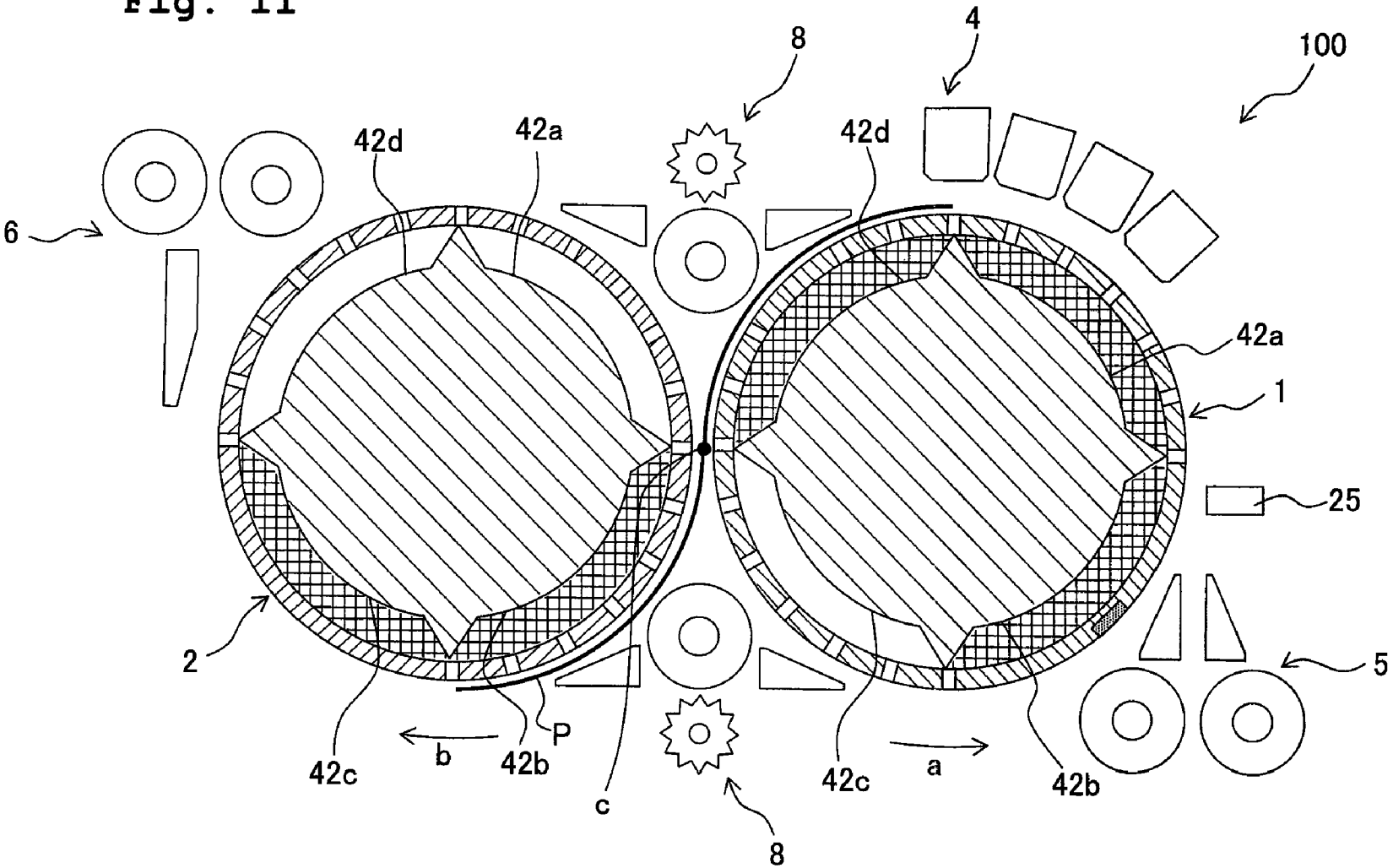
FIG. 11 is a diagram showing an operation of the printer (transfer at the nearest point) when the single face printing mode is selected.

Next, as shown in FIG. 11, in the first drum 1, since the decompression chamber 42*d* near the nearest point C is in a decompressed state, the printing paper P is transported up to the nearest point C by the rotation of the first drum 1. On the other hand, in the second drum 2, the decompression chambers 42*b* and 42*c* are decompressed, and furthermore, the second drum 2 is rotated in a reverse rotation direction of the first drum 1 (arrow-b direction). Accordingly, at the nearest point C, the printing paper P is transferred from the first drum 1 to the second drum 2. At this time, the printing paper P is turned over.

Figure 12:
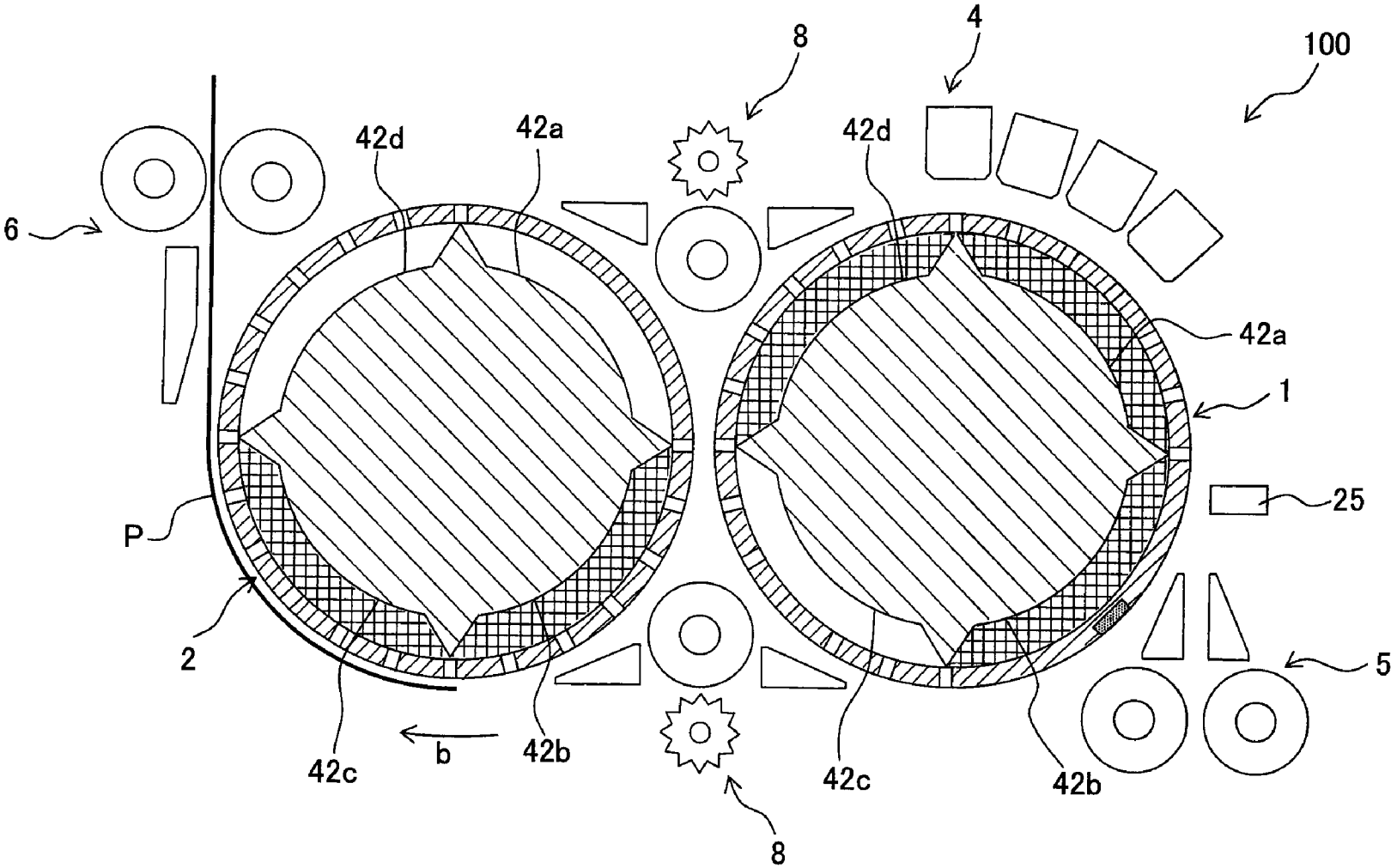
FIG. 12 is a diagram showing an operation of the printer (paper discharge) when the single face printing mode is selected.

Moreover, as shown in FIG. 12, after the printing paper P is transported up to the paper discharge mechanism 6 by rotating the second drum 2 in the arrow-b direction with the printing paper P being attached, the printing paper P is separated from the second drum 2 in the area corresponding to the decompression chamber 42*d*, and the printing paper P having one surface (front surface) printed is discharged from the second drum 2 by the paper discharge mechanism 6.

In the single face printing mode, since it is not necessary to print the rear surface, it is not necessarily required to turnover the front surface and the rear surface after the front surface has been printed as in FIG. 11. Therefore, when the paper supply position and the paper discharge position are set appropriately, it is possible to transport the printing paper P through a path on an outer side of the first drum 1 and the second drum 2 (path not passing through the nearest point C), and to discharge the printing paper P without turning the front surface and the rear surface. However, in such path, the printing paper P is transported in a state of the front surface thereof being exposed all the time, and only the curling forming a projection toward the front surface acts on the printing paper P, thereby making a substantial curling susceptible to occur. Therefore, from a viewpoint of suppressing the curling, it is preferable to turn over the printing paper P presumably by transporting the printing paper P is the form of an English alphabet S, and to make act the curling in two directions in the printing paper P. In this case, the printing paper P is to be turned over immediately after printing. In other words, immediately after printing, the printing surface (the front surface) of the printing paper P faces the second drum 2. However, in a case in which a quick drying ink is used, even when the printing paper P is turned over immediately after printing, a problem such as of staining of an image etc. does not occur. In such case, it is particularly preferable to make act the curling in two directions in the printing paper P as mentioned above.

In the printer 100 of the embodiment described above, the printing paper P is turned over at the time of transfer between the first drum 1 and the second drum 2 while restraining the printing paper P by attaching to the first drum 1 and the second drum 2. Therefore, it is possible to suppress the curling of the printing paper P during transportation and at the time of turning over the front surface and the rear surface. Furthermore, when the printing paper P having the front surface and the rear surface turned over is returned to the first drum 1 facing the ink-jet head 4, it is possible to print both the front surface and the rear surface of the printing paper P by the ink-jet head 4 facing the first drum 1. Consequently, it is possible to carry out printing on both surfaces while suppressing the curling of the printing paper P by a comparatively simple structure. Moreover, when the double face printing mode is selected, the printing paper P is transported such that the curling in two directions acting on the printing paper P is even. In this case, the curling of the printing paper P is further suppressed.

Apart from the double face printing mode, it is also possible to select the single face printing mode in which the printing paper P is not returned to the ink-jet head 4 after one surface thereof has been printed, and it is possible to carry out printing on the single surface thereof. Moreover, even when the single face printing mode is selected, it is possible to transport the printing paper P such that the curling in two directions acts on the printing paper P, and then it is possible to suppress the curling of the printing paper P.

The holding mechanism 8 which holds the printing paper P is provided on the external common tangents 35 and 36 of the first drum 1 and the second drum 2. Here, at the time of transfer of the printing paper P on the external common tangents 35 and 36, the printing paper P is separated instantaneously from the first drum 1 and the second drum 2. Even in this case, it is possible to hold the printing paper P assuredly and to suppress the curling.

Next, modified embodiments in which various modifications are made in the embodiment will be described below. However, same reference numerals are assigned to components having the same structure as in the embodiment, and the description of such components is omitted.

First Modified Embodiment

Figure 13:
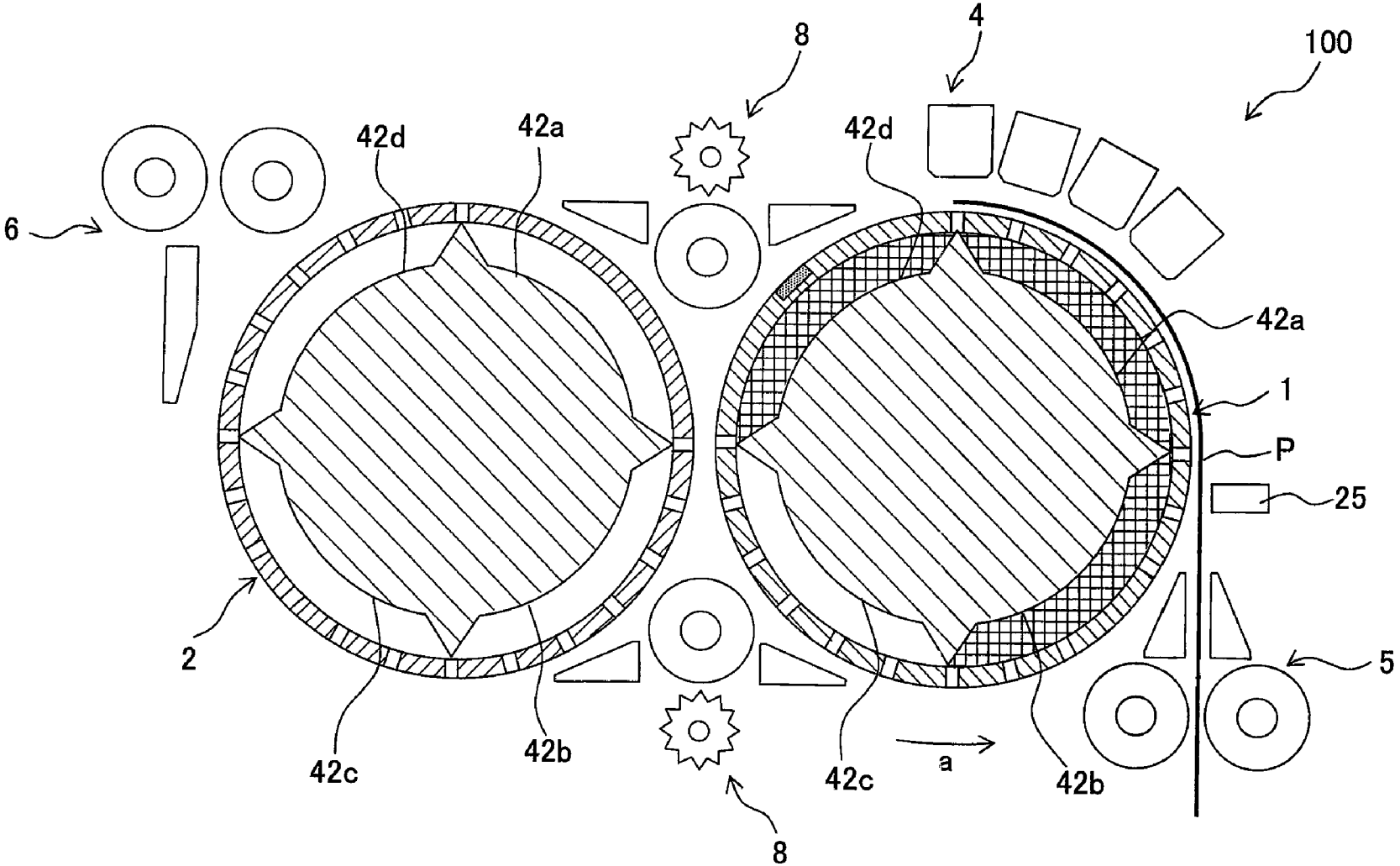
FIG. 13 is a diagram showing an operation of a printer according to a modified embodiment (paper feeding and front-surface printing) when a double face printing mode is selected.
Figure 14:
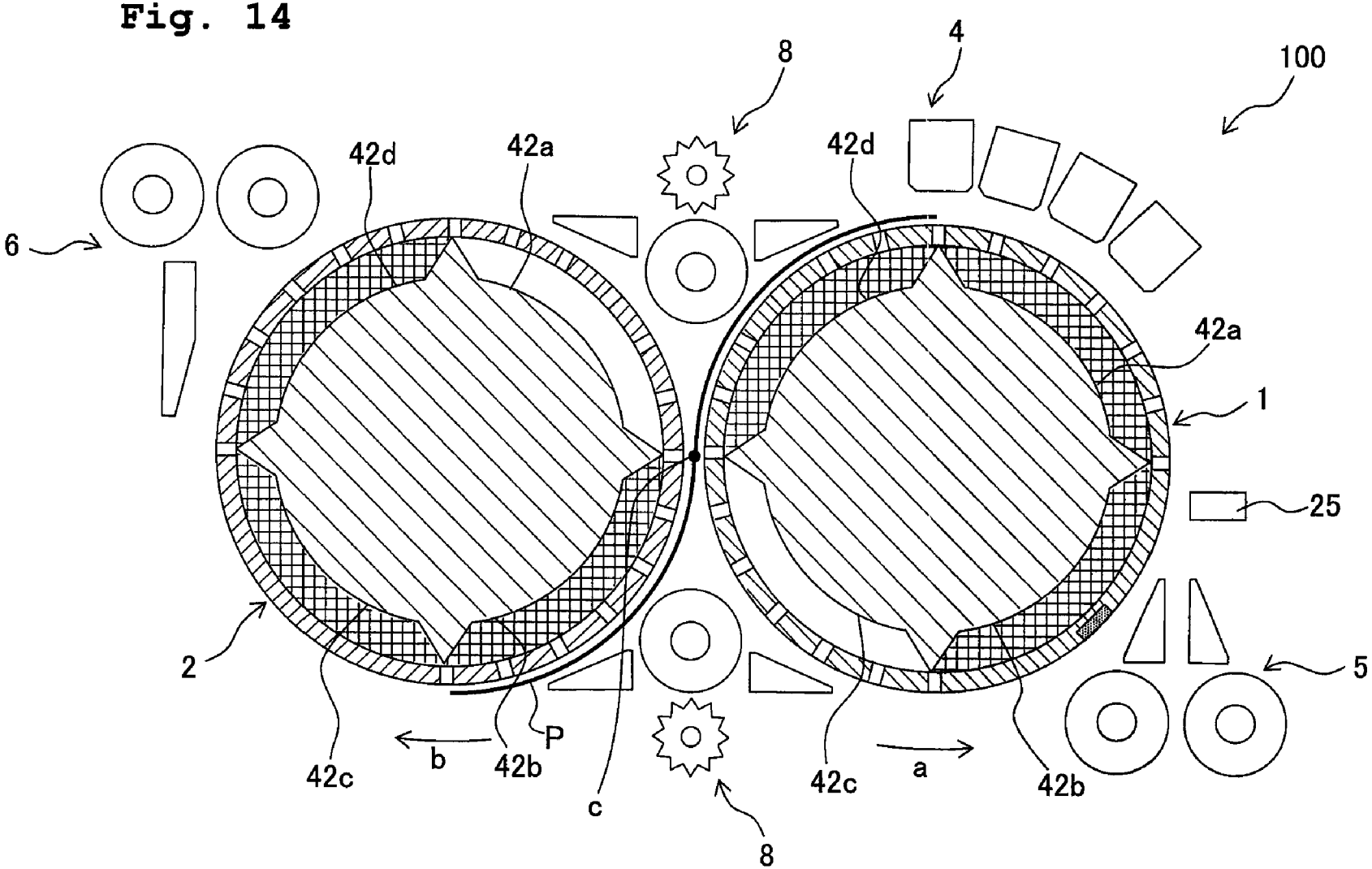
FIG. 14 is a diagram showing an operation of the printer according to the modified embodiment (transfer at the nearest point) when the double face printing mode is selected.
Figure 15:
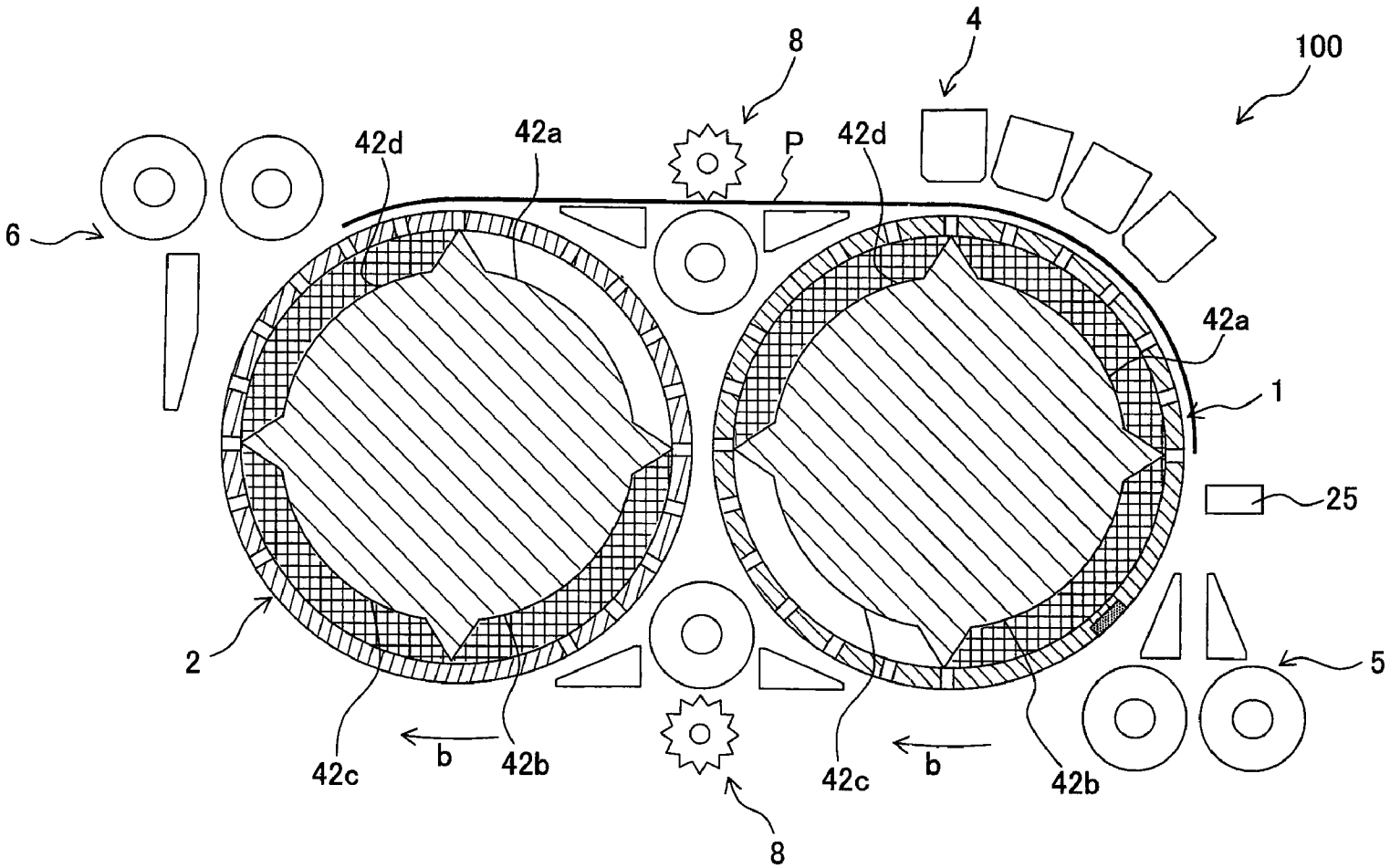
FIG. 15 is a diagram showing an operation of the printer according to the modified embodiment (transfer at the external common tangent and rear-surface printing) when the double face printing mode is selected.
Figure 16:
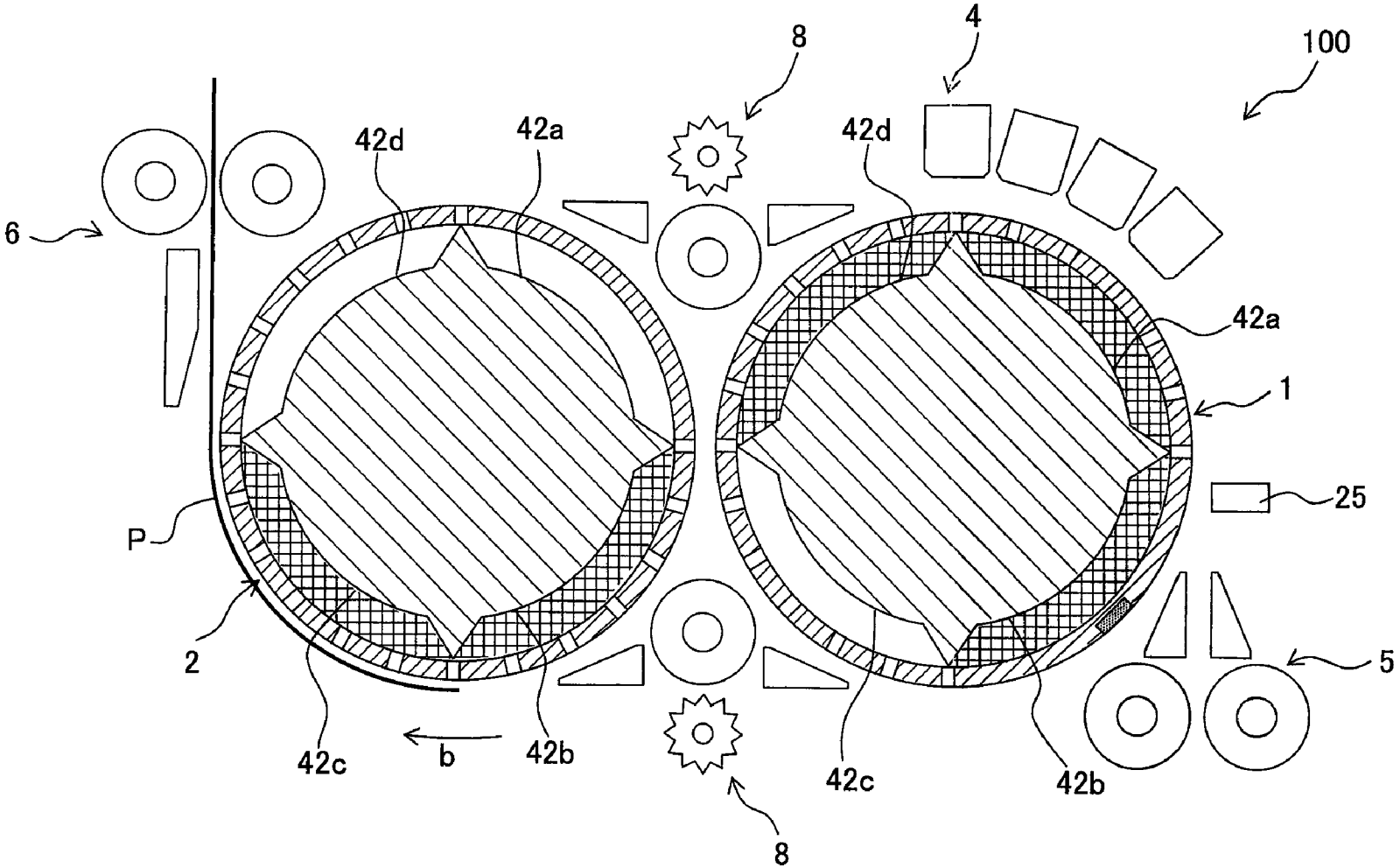
FIG. 16 is a diagram showing an operation of the printer according to the modified embodiment (paper discharge) when the double face printing mode is selected.

The transporting path of the printing paper P in double face printing is not restricted to the path in the embodiment. For instance, a path shown in FIGS. 13 to 16 may be adopted. As shown in FIG. 13, the ink-jet head 4 carries out printing on the front surface of the printing paper P attached to the first drum 1. Next, as shown in FIG. 14, the printing paper P is transferred while the printing paper P is turned over at the nearest point C of the first drum 1 and the second drum 2. Thereafter, as shown in FIG. 15, the printing paper P is transferred, through one external common tangent of the first drum 1 and the second drum 2 (upper side), from the second drum 2 to the first drum 1 without being turned over. Then, the ink-jet head 4 carries out the printing of the rear surface of the printing paper P. Finally, the printing paper P is passed on from the first drum 1 to the second drum 2 on the other external tangent of the first drum 1 and the second drum 2 (lower side), and then the printing paper P is discharged from the second drum 2 by the paper discharge mechanism 6.

Even in the path described above, after the printing paper P of which front surface has been printed on the first drum 1 is turned over at the time of transfer between the first drum 1 and the second drum 2, the printing paper P is returned to the first drum 1 to perform printing on the rear surface thereof. However, in this path, after the front surface of the printing paper P is printed at the first drum, the printing paper P is turned over at the nearest point C immediately. Therefore, from a viewpoint that the front surface of the printing paper P which is printed is prevented from being stained at the time of turning over, the path of the embodiment is preferable (see FIGS. 4 to 9). In the embodiment described above, the printing paper P is not turned over immediately after printing of the front surface, because the printing paper P is transported through the external common tangent of the first drum 1 and the second drum 2. However, the printing paper P is turned over at the time of transferring to the first drum 1 at the nearest point C after drying the front surface thereof while the printing paper P is attached to the second drum 2.

Moreover, an attaching mechanism which attaches the printing paper P to the first drum 1 and the second drum 2 is not restricted to the structure in the embodiment, and appropriate modifications are possible. For instance, the plurality of suction pumps 43 may be connected one-to-one to the plurality of decompression chambers 42. In this case, it is possible to decompress each of the decompression chambers 42 independently by controlling a suction force of the corresponding one of the suction pumps 43, or by controlling ON/OFF operation of the corresponding one of the suction pumps 43.

Moreover, the partition walls 41 each of which divides the decompression chamber 42 may be provided not on the outer peripheral surface of the fixed body 40 but on the inner surface of the first drum 1 and the second drum 2. Furthermore, the plurality of decompression chambers 42 which correspond one-to-one to the plurality of through holes 13 formed in the first drum 1 and the second drum 2 may be formed between the fixed body 40 and the first drum 1 (the second drum 2).

Moreover, the attaching mechanism is not restricted to a decompression mechanism (suction mechanism) for the decompression chambers 42 as described in the above embodiment. For instance, the attaching mechanism may be a so-called electrostatic typed attaching mechanism in which the printing paper P is attached by an electrostatic force generated by a static electricity in the outer peripheral surface of the first drum 1 and the second drum 2.

In the embodiment described above, as a transfer mechanism which transfers the printing paper P between the first drum 1 and the second drum 2, an example of a structure of transferring the printing paper P by changing an attaching force of the attaching mechanism 3 of the first drum 1 and the second drum 2 has been cited. However, the transfer mechanism is not restricted to a mechanism having such structure. For instance, the transfer mechanism may have a structure including a paper guide and a roller in contact with the outer peripheral surface of the first drum 1 and the second drum 2, and in which the printing paper P is pulled off (is detached) forcibly from the outer peripheral surface of the first drum 1 and the second drum 2 by exerting a detaching force directly to the printing paper P.

In the embodiment described above, the printing paper P is transported while the printing paper P is turned over only by the first drum 1 and the second drum 2. However, the printing paper P may be transported or turned over by using an additional member (such as another drum and a auxiliary roller) apart from the first drum 1 and the second drum 2.

Figure 17:
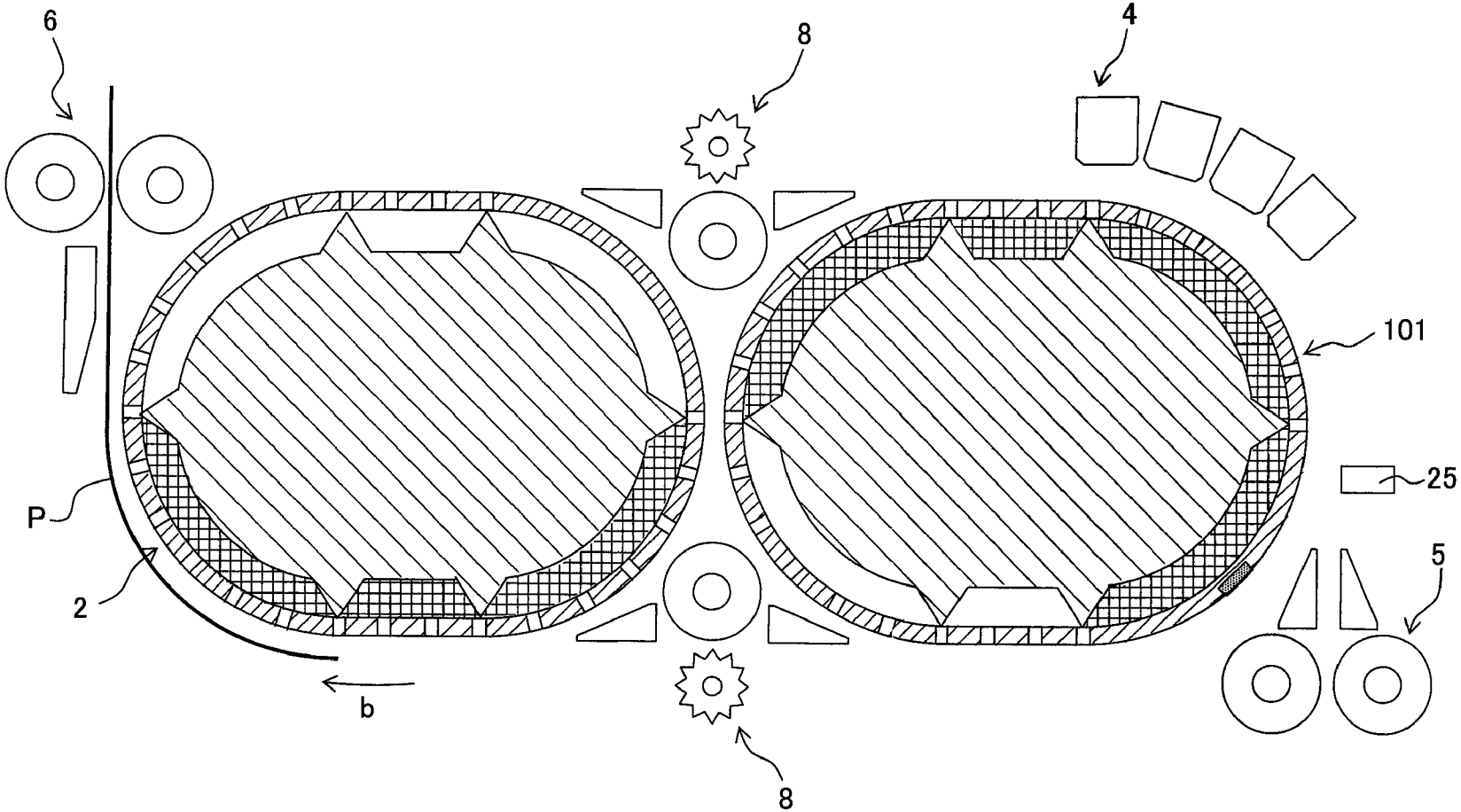
FIG. 17 is a diagram showing a rotating belt as an example of a rotatable body.

As shown in FIG. 17, it is also possible to use belts 101 and 102 which are rotatably provided, instead of the first drum 1 and the second drum 2. A plurality of holes is formed in an outer surface of the belts 101 and 102, similarly as on the first drum 1 and the second drum 2. Moreover, similarly as an interior portion of the first drum 1 and the second drum 2, a space at an inner side surrounded by the belts 101 and 102 may be divided into a plurality of cells and it is possible to decompress each cell independently. Therefore, similarly as in a case in which the first drum 1 and the second drum 2 are used, it is possible to suck the printing paper P through the through holes communicating with the divided cell by decompressing the cell formed in the space at the internal portion of the belts 101 and 102. In this manner, in a case of using the belts 101 and 102, since it is possible to set freely the path of the belts 101 and 102 as compared to the first drum 1 and the second drum 2, it is possible to improve a degree of freedom of transporting path of the printing paper P. Moreover, a drum and a belt may be combined.

In a case of the belts 101 and 102, similarly as the first drum 1 and the second drum 2, instead of decompressing an internal space, the printing paper P may be attached by an electrostatic force by arranging an electrode on the surface of the belts 101 and 102. Or, when the printing paper P or the ink includes a material which reacts to a magnet, such as an iron powder or a nickel powder, the printing paper P may be held on the surface of the first drum 1 and the second drum 2 (on the surface of the belts 101 and 102) by using a magnetic force of an electromagnet or a permanent magnet arranged on the surface of the drums/belts. Moreover, the first drum 1 (the belt 101) and the second drum 2 (the belt 102) are not necessarily required to hold the printing paper P by the same mechanism. For instance, the first drum 1 (the belt 101) may have a suction mechanism which sucks the printing paper P by using a decompression mechanism as mentioned above, and the second drum 2 (the belt 102) may have a mechanism which holds the printing paper P by using an electrostatic force. Or, the first drum 1 (the belt 101) may have a suction mechanism which sucks the printing paper P by using a decompression mechanism as mentioned above, and the surface of the second drum 2 (the belt 102) may be adhesive. Even in this case, it is possible to control the transfer of the printing paper P from the first drum 1 (the belt 101) to the second drum 2 (the belt 102) by switching ON/OFF the suction mechanism of the first drum 1 (the belt 101).

In the embodiment described above, a non-reversing transfer of the printing paper P in which the printing paper P is transferred between the first drum 1 and the second drum 2 without reversing the printing paper P has been carried out on the external common tangent of the first drum 1 and the second drum 2. However, the non-reversing transfer is not necessarily required to be carried out on the external common tangent, and an arrangement may be made such that the non-reversing transfer not involving the turning over of the printing paper is carried out on a path located near a drum side with respect to the external common tangent, or on a path somewhat shifted on an opposite side of the drum.

In the embodiment described above, a diameter of the first drum 1 and a diameter of the second drum 2 are same. However, the diameter of the first drum 1 and the second drum 2 may have a different size.

For instance, when the diameter of the second drum 2 is larger than the diameter of the first drum 1, the time in which the printing paper P attached to the second drum 2 is transported in the circumferential direction becomes longer as compared to the time in which the printing paper P attached to the first drum 1 is transported. Therefore, as in the embodiment described above, when an arrangement is made such that the printing paper P is transferred from the first drum 1 to the second drum 2 without reversing, immediately after the front surface of the printing paper P has been printed, the drying of the ink on the front surface is carried out assuredly while the printing paper P is transported in the circumferential direction by the second drum 2.

Moreover, when the diameter of the second drum 2 is made to be sufficiently larger (about several folds) than the diameter of the first drum 1, it becomes possible to attach simultaneously a plurality of printing papers P to the outer peripheral surface of the second drum 2. Accordingly, by supplying continuously the plurality of printing papers P attached to the second drum 2 to the first drum 1, it is possible to carry out the printing of the plurality of printing papers P continuously. It is desirable that the second drum 2 has a diameter which enables to hold entirely a printing paper of the maximum size that can be assumed, on the outer peripheral surface thereof.

The paper feeding position of supplying the printing paper P to the first drum 1 and the paper discharge position of discharging the printing paper P from the second drum 2 are not restricted to the positions described in the above embodiment, and it is possible to change upon taking into consideration a layout of another structure.

In the embodiment described above, when the printing paper P is transferred from the paper feeding mechanism 5 to the first drum 1, and when the printing paper P is transferred from the first drum 1 to the second drum 2, the front end of the printing paper P is positioned to coincide with specific through holes 13*a* which are adjacent in the area, of the first drum 1 and the second drum 2, in which the through holes are not formed. However, in a case in which the printing paper P is transferred from one drum to the other drum for discharge or for drying, it is not necessary to carry out alignment (position adjustment) of the front end of the printing paper P and the through hole as strictly as mentioned above.

What is claimed is:

1. A printer which jets an ink onto a printing medium to perform printing, comprising:

a first rotatable body which has an outer peripheral surface;

a first rotational drive mechanism which drives the first rotatable body to rotate;

a first attaching mechanism which is configured to attach the printing medium to the outer peripheral surface of the first rotatable body;

an ink-jet head which is arranged to face the outer peripheral surface of the first rotatable body, and which performs the printing by jetting the ink onto the printing medium attached to the outer peripheral surface of the first rotatable body;

a second rotatable body which has an outer peripheral surface and which is arranged to be near to the first rotatable body to face the first rotatable body;

a second rotational drive mechanism which drives the second rotatable body to rotate;

a second attaching mechanism which is configured to attach the printing medium to an outer peripheral surface of the second rotatable body;

a transfer mechanism which transfers the printing medium between the first and second rotatable bodies, the transfer mechanism having:

a first transfer path; and a second transfer path;

wherein the first transfer path connects the first rotatable body and the second rotatable body, and runs through a facing area, which is located between the first rotatable body and the second rotatable body and at which the first rotatable body faces the second rotatable body; and wherein the second transfer path connects the first rotatable body and the second rotatable body, without running through the facing area; and a transporting control mechanism controlling the first and second rotational drive mechanisms:

to transfer the printing medium, having a front surface for which the printing has been performed by the ink-jet head, from one rotatable body of the first and second rotatable bodies to the other rotatable body of the first and second rotatable bodies, via the first transfer path of the transfer mechanism; and to transfer the printing medium having the printed front surface from the other rotatable body to the one rotatable body, via the second transfer path of the transfer mechanism.

2. The printer according to claim 1;

wherein the first rotatable body comprises a first drum and the second rotatable body comprises a second drum, the first and second drums having a circular cylindrical shape.

3. The printer according to claim 1;

wherein the first rotatable body comprises a first belt and the second rotatable body comprises a second belt, the first and second belt having a form of an endless belt.

4. The printer according to claim 2;

wherein the first transfer path runs through a nearest point at which the first drum and the second drum are nearest to each other, and the second transfer path runs through an external common tangent extending between the first drum and the second drum.

5. The printer according to claim 4;

wherein the transport control mechanism controls the first and second rotational drive mechanisms such that:

firstly, the printing medium having the printed front surface is transferred from the first drum to the second drum via the second transfer path, while the first drum and the second drum are made to rotate in a first direction; and next, the printing medium is turned over by making the printing medium be transferred from the second drum to the first drum through the first transfer path, while the first drum is made to rotate in a direction opposite to the first direction with the printing medium being attached only to the outer peripheral surface of the second drum.

6. The printer according to claim 5;

wherein the second transfer path is formed as two second transfer paths; and wherein the transporting control mechanism controls the first and second rotational drive mechanisms to transfer the printing medium from the first drum to the second drum via one of the two second transfer paths.

7. The printer according to claim 6;

wherein a supply position at which the printing medium is supplied to the first drum and a discharge position at which the printing medium is discharged from the second drum are located symmetrically with respect to the nearest point;

wherein a direction of supplying of the printing medium at the supply position and a direction of discharging of the printing medium at the discharge position are parallel; and wherein the transporting control mechanism controls the first and second rotational drive mechanisms to transfer the printing medium, having a rear surface for which the printing has been also performed, on the other external common tangent from the first drum to the second drum to be discharged at the discharge position while the second drum is made to rotate in the second direction after the rear surface of the printing medium, which is returned to the first drum from the second drum, has been printed by the ink-jet head.

8. The printer according to claim 2;

wherein a holding mechanism, which holds the printing medium to be transferred between the first drum and the second drum, is provided in the second transfer path.

9. The printer according to claim 8;

wherein the holding mechanism includes:

a first roller which has a plurality of protrusions arranged in a circumferential direction thereof; and a second roller which has a circular cylindrical shape and which is arranged facing the first roller;

wherein the second transfer path is sandwiched between the first and second rollers.

10. The printer according to claim 2;

wherein the transporting control mechanism is capable of selectively performing a double face printing mode and a single face printing mode;

wherein, in the double face printing mode, after the printing medium is turned over, the transporting control mechanism controls the first and second rotational drive mechanisms to transport the printing medium having the printed front surface to the ink-jet head to perform the printing on a rear surface of the printing medium; and wherein, in the double face printing mode, the transporting control mechanism controls the first and second rotational drive mechanisms to discharge the printing medium having the printed front surface, without transporting the printing medium to the ink-jet head.

11. The printer according to claim 10;

wherein the transporting control mechanism controls the first and second rotational drive mechanisms such that, in both of the double face printing mode and the single face printing mode, while the printing medium is transported by the first drum and the second drum, the printing medium is curled in two directions of a direction in which the printing medium is curled to project on one surface thereof and a direction in which the printing medium is curled to project on the other surface thereof.

12. The printer according to claim 2;

wherein the transfer mechanism transfers the printing medium between the first drum and the second drum by controlling the first attaching mechanism and the second attaching mechanism:

to decrease an attaching force of one of the first and second drums out of which the printing medium is to be transferred; and to increase an attaching force of the other drum to which the printing medium is to be transferred.

13. The printer according to claim 12;

wherein a plurality of through holes is formed in an outer peripheral surface of each of the first and second drums, the through holes being arranged in a peripheral direction of each of the first and second drums;

wherein each of the first and second attaching mechanisms includes:

a column-shaped fixed body which is arranged in the drum facing, with a space between an inner surface of the drum and the fixed body;

a plurality of partition walls which are provided, with a spacing distance in a circumferential direction of the fixed body, on an inner peripheral surface of the drum or on an outer peripheral surface of the fixed body;

a plurality of decompression chambers which are defined by the partition walls dividing the space between the fixed body and the drum in the circumferential direction; and a decompression mechanism which is capable of independently decompressing each of the decompression chambers, and wherein the plurality of through holes communicate to the decompression chambers.

14. The printer according to claim 13, wherein each of the first and second drums has an area in which the through holes are not formed;

wherein a length in a circumferential direction of the area is not less than a length in a circumferential direction of the drum corresponding to one of the decompression chambers;

wherein the printer further comprises a position detecting mechanism which detects a position of a front end portion of the printing medium; and wherein the transporting control mechanism controls the first and second rotational drive mechanisms based on a detection result of the position detecting mechanism such that the front end portion of the printing medium is attached, in a direction opposite to the direction of rotation of the drum, via a through hole, among the through holes, which is located nearest to the area.

* * * * *